US008622330B2

(12) United States Patent
Mepham et al.

(10) Patent No.: US 8,622,330 B2
(45) Date of Patent: Jan. 7, 2014

(54) MILL LINER ASSEMBLY

(75) Inventors: Robert Mepham, Fergus (CA); David J. Page, Elora (CA); Pramod Kumar, Waterloo (CA)

(73) Assignee: Polycorp Ltd., Elora, Ontario (CA)

( * ) Notice: Subject to any disclaimer, the term of this patent is extended or adjusted under 35 U.S.C. 154(b) by 92 days.

(21) Appl. No.: 13/349,786

(22) Filed: Jan. 13, 2012

(65) Prior Publication Data

US 2012/0181364 A1 Jul. 19, 2012

Related U.S. Application Data

(60) Provisional application No. 61/432,406, filed on Jan. 13, 2011.

(51) Int. Cl.
*B02C 17/14* (2006.01)

(52) U.S. Cl.
USPC ..... 241/182; 241/183

(58) Field of Classification Search
USPC ..... 241/182, 183
See application file for complete search history.

(56) References Cited

U.S. PATENT DOCUMENTS

| | | | | |
|---|---|---|---|---|
| 2,058,257 | A | 4/1935 | Porteous | |
| 3,804,346 | A | 4/1974 | Norman | |
| 4,141,511 | A | 2/1979 | Anderson | |
| 4,177,955 | A * | 12/1979 | Miller | 241/183 |
| 4,289,279 | A * | 9/1981 | Brandt | 241/102 |
| 4,319,719 | A * | 3/1982 | Larsen | 241/183 |
| 4,341,355 | A * | 7/1982 | Hornberger | 241/102 |
| 4,402,465 | A * | 9/1983 | Persson et al. | 241/183 |
| 4,424,938 | A | 1/1984 | Day | |
| 4,609,158 | A | 9/1986 | Wilson | |
| 4,848,681 | A | 7/1989 | Eriksson et al. | |
| 5,019,196 | A | 5/1991 | McKibben et al. | |
| 5,104,049 | A | 4/1992 | McKibben et al. | |
| 5,431,351 | A | 7/1995 | Lejonklou | |
| 5,516,051 | A | 5/1996 | Brisbois et al. | |
| 5,752,665 | A | 5/1998 | Wason | |
| 6,036,127 | A | 3/2000 | Moller | |
| 6,206,310 | B1 | 3/2001 | Schneider | |
| 6,622,951 | B1 | 9/2003 | Recker et al. | |
| 7,861,960 | B2 | 1/2011 | Bhide | |
| 7,887,000 | B2 | 2/2011 | Siitonen et al. | |

(Continued)

FOREIGN PATENT DOCUMENTS

| | | |
|---|---|---|
| FR | 2615409 | 11/1988 |

*Primary Examiner* — Faye Francis

(57) ABSTRACT

A mill liner assembly for mounting on an inner diameter of a shell of a grinding mill. The mill liner assembly includes one or more shell plates for engagement with the shell, each of the shell plates having a cooperating portion thereof, and one or more lifter bars, each of the lifter bars having a mounting portion thereof, the mounting portion being receivable on the cooperating portion. The mill liner assembly also includes one or more layers having one or more substantially non-resilient materials and a substantially non-sticking surface. The layer is at least partially positioned on at least a first selected one of the cooperating portion and the mounting portion, to position the non-sticking surface thereof for engagement with a second selected one of the cooperating portion and the mounting portion, to impede adhesion of the shell plate and the lifter bar to each other.

2 Claims, 21 Drawing Sheets

(56) References Cited

U.S. PATENT DOCUMENTS

| | | | |
|---|---|---|---|
| 2002/0134871 | A1 | 9/2002 | Anderson |
| 2003/0141396 | A1 | 7/2003 | Whaley |
| 2007/0284464 | A1 | 12/2007 | Nordell |
| 2009/0065618 | A1 | 3/2009 | Abarca Melo et al. |
| 2009/0166456 | A1 | 7/2009 | Hellman et al. |
| 2010/0127109 | A1 | 5/2010 | Moller et al. |
| 2011/0073694 | A1 | 3/2011 | Timm et al. |

* cited by examiner

MILL LINER ASSEMBLY

This application claims the benefit of U.S. Provisional Patent Application No. 61/432,406, filed on Jan. 13, 2011, and incorporates such provisional patent application in its entirety by reference.

FIELD OF THE INVENTION

The present invention is related to a mill liner assembly to be mounted on a shell of a grinding mill, the mill liner assembly including a layer providing a substantially non-sticking surface for impeding adhesion of elements of the mill liner assembly with each other or with the shell.

BACKGROUND OF THE INVENTION

As is well known in the art, an inner diameter of a shell of a grinding mill typically is lined with a mill liner, for wear protection, i.e., to protect the shell. The mill liner may include, for instance, shell plates positioned on the inner diameter so as to substantially cover the shell's inner diameter, and lifter bars spaced apart from each other, with the shell plates positioned between the lifter bars and the shell. The heads of bolts extending through the shell are held in the lifter bars respectively, so that tightening nuts on the portions of the bolts extending outside the shell urges the lifter bars against the shell plates and ultimately the shell, for securing the lifter bars and shell plates to the shell. The lifter bars are positioned to press onto portions of the shell plates, to hold the shell plates against the inner diameter. As is known, the shell plates and the lifter bars typically are made of various materials, for instance, the shell plates may be made of steel and/or a rubber or rubber-like material, and the lifter bars may be made of steel, and/or rubber or rubber-like material.

Typically, once the mill liner has become worn to a certain extent, all or part of the mill liner is replaced. Often, only a part of the mill liner is to be replaced. For instance, the lifter bars may have a substantially shorter useful life than the shell plates on which the lifter bar is at least partially positioned. In this situation, when the lifter bars have become worn, it is sometimes intended to replace only the lifter bars, i.e., where the shell plates still have a substantial portion of their useful life remaining. However, in practice, removal of the lifter bars alone (i.e., without removing some or all of the shell plates) is usually very difficult. This is because each lifter bar, and the shell plates with which the lifter bar is engaged, tend to become relatively securely fused or bonded to each other over time. It appears that the mechanism which results in parts of the mill liner adhering together after use over a period of time has not been studied in detail. It is thought that, where the fused elements include one or more elastomeric materials, the elements tend to adhere together over time due to compression set.

SUMMARY OF THE INVENTION

For the foregoing reasons, there is a need for an improved mill liner assembly in which elements thereof are readily separable from each other after use over a time period.

In its broad aspect, the invention provides a mill liner assembly for mounting on an inner diameter of a shell of a grinding mill. The mill liner assembly includes one or more shell plates for engagement with the shell, each of the shell plates having a cooperating portion thereof, one or more lifter bars, each of the lifter bars having a mounting portion thereof, the mounting portion being receivable on the cooperating portion, and one or more layers having one or more substantially non-resilient materials and a substantially non-sticking surface. The layer is at least partially positioned on at least a first selected one of the cooperating portion and the mounting portion, to position the non-sticking surface thereof for engagement with a second selected one of the cooperating portion and the mounting portion, to impede adhesion of the shell plate and the lifter bar to each other.

An embodiment of the present invention provides a mill liner assembly for mounting on an inner diameter of a shell of a grinding mill. The mill liner assembly includes one or more shell plates for engagement with the shell, each of the shell plates having a cooperating portion thereof, one or more lifter bars, each of the lifter bars having a mounting portion thereof, the mounting portion being receivable on the cooperating portion, and two or more layers, each of the layers having one or more substantially non-resilient materials and a substantially non-sticking surface. The layers are respectively positioned, at least partially, on the cooperating portion and the mounting portion, to position the respective non-sticking surfaces of the layers for engagement with each other, to impede adhesion of the shell plate and the lifter bar to each other.

According to one aspect of the present invention, there is provided a method of forming a mill liner assembly for mounting on an inner diameter of a shell of a grinding mill. The method includes the steps of: providing one or more shell plates for engagement with the shell, each of the shell plates having a cooperating portion thereof; providing one or more lifter bars, each of the lifter bars having a mounting portion thereof, the mounting portion being receivable on the cooperating portion; and positioning one or more layers including one or more substantially non-resilient materials and a substantially non-sticking surface on at least a first selected one of the cooperating portion and the mounting portion, to position the non-sticking surface thereof for engagement with a second selected one of the cooperating portion and the mounting portion, to impede adhesion of the shall plate and the lifter bar to each other.

In another aspect, the invention provides a grinding mill, including a shell having an inner diameter thereof, and a mill liner assembly for mounting on the inner diameter of the shell. The mill liner assembly includes one or more shell plates for engagement with the shell, each of the shell plates having a cooperating portion thereof, one or more lifter bars, each of the lifter bars having a mounting portion thereof, the mounting portion being receivable on the cooperating portion, one or more fastener subassemblies, for at least partially securing the shell plate and the lifter bar to the shell, and one or more layers including one or more substantially non-resilient materials and a substantially non-sticking surface at least partially positioned on at least a first selected one of the cooperating portion and the mounting portion, to position the non-sticking surface thereof for engagement with a second selected one of the cooperating portion and the mounting portion, to impede adhesion of the shell plate and the lifter bar to each other, when the shell plate and the lifter bar are secured to the shell.

In another of its aspects, the invention provides a mill liner assembly including one or more lifter bars for engagement with a shell surface defining an inner diameter of a shell of a grinding mill, each of the lifter bars having a mounting portion receivable on the shell surface, and one or more layers including one or more non-resilient materials and a substantially non-sticking surface at least partially positioned on a first selected one of the mounting portion and the shell surface, to position the non-sticking surface for engagement with a second selected one of the mounting portion and the shell surface, to impede adhesion of said at least one lifter bar and the shell to each other.

In another of its aspects, the invention provides a mill liner assembly including one or more shell plates for engagement with a shell surface defining an inner diameter of a shell of a grinding mill, each of the shell plates including a cooperating portion thereof, and one or more layers including one or more non-resilient materials and a substantially non-sticking surface at least partially positioned on a first selected one of the cooperating portion and the shell surface, to position the non-sticking surface for engagement with a second selected one of the cooperating portion and the shell surface, to impede adhesion of the shell plate and the shell to each other.

In yet another of its aspects, the invention provides a mill liner assembly including one or more shell plates for engagement with an inner diameter of a shell of a grinding mill, the shell including a shell body having an interior surface and an elastomeric sheet positioned on the interior surface to define the inner diameter. The mill liner assembly includes one or more protective elements attached to the shell plate for engagement with the elastomeric sheet when the shell plate is fastened to the shell, the protective element including one or more substantially tear-resistant materials, for substantially protecting the elastomeric sheet.

BRIEF DESCRIPTION OF DRAWINGS

The invention will be better understood with reference to the attached drawings, in which.

DETAILED DESCRIPTION

Figure 1A:
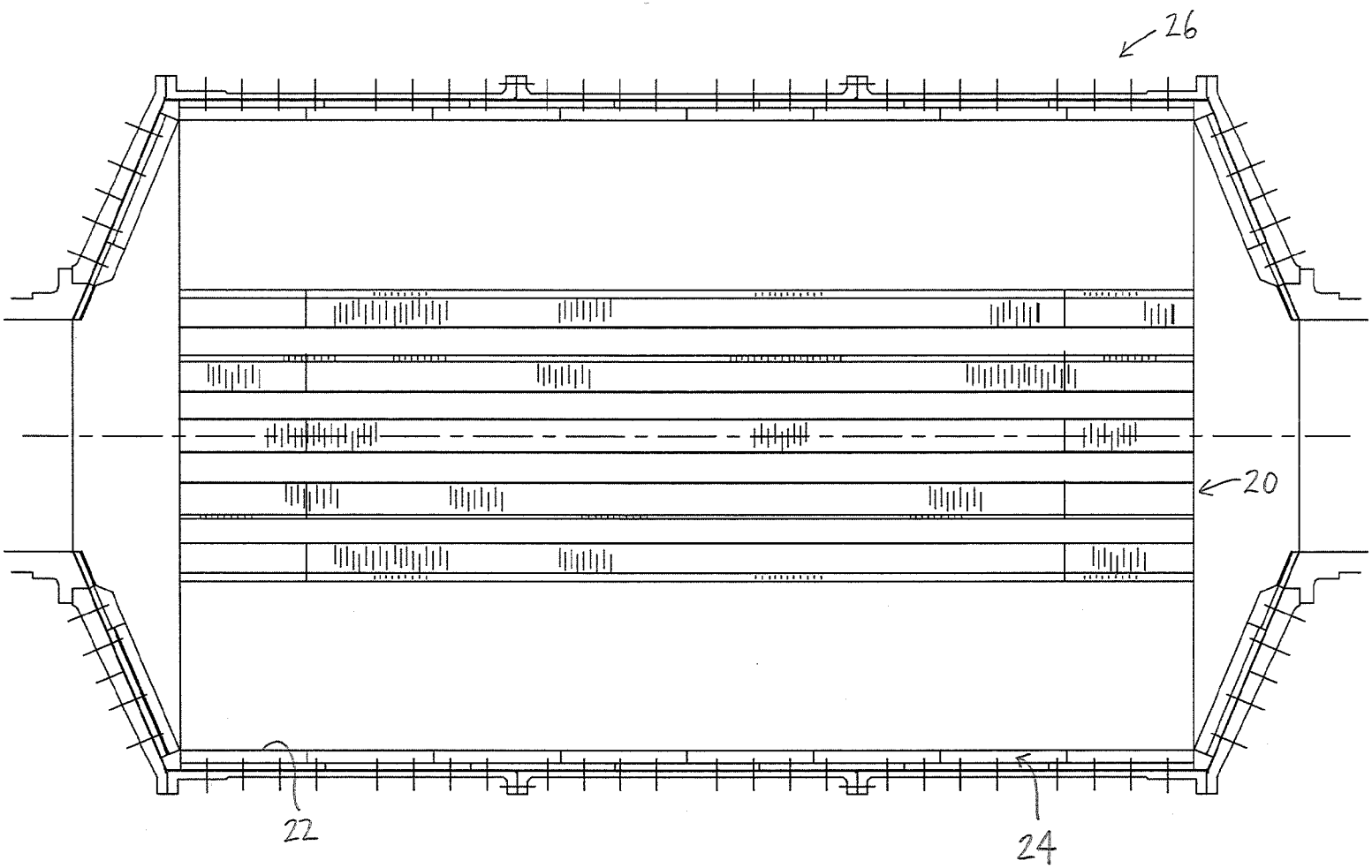
FIG. 1A is a cross-section of a grinding mill including an embodiment of a mill liner assembly.
Figure 1B:
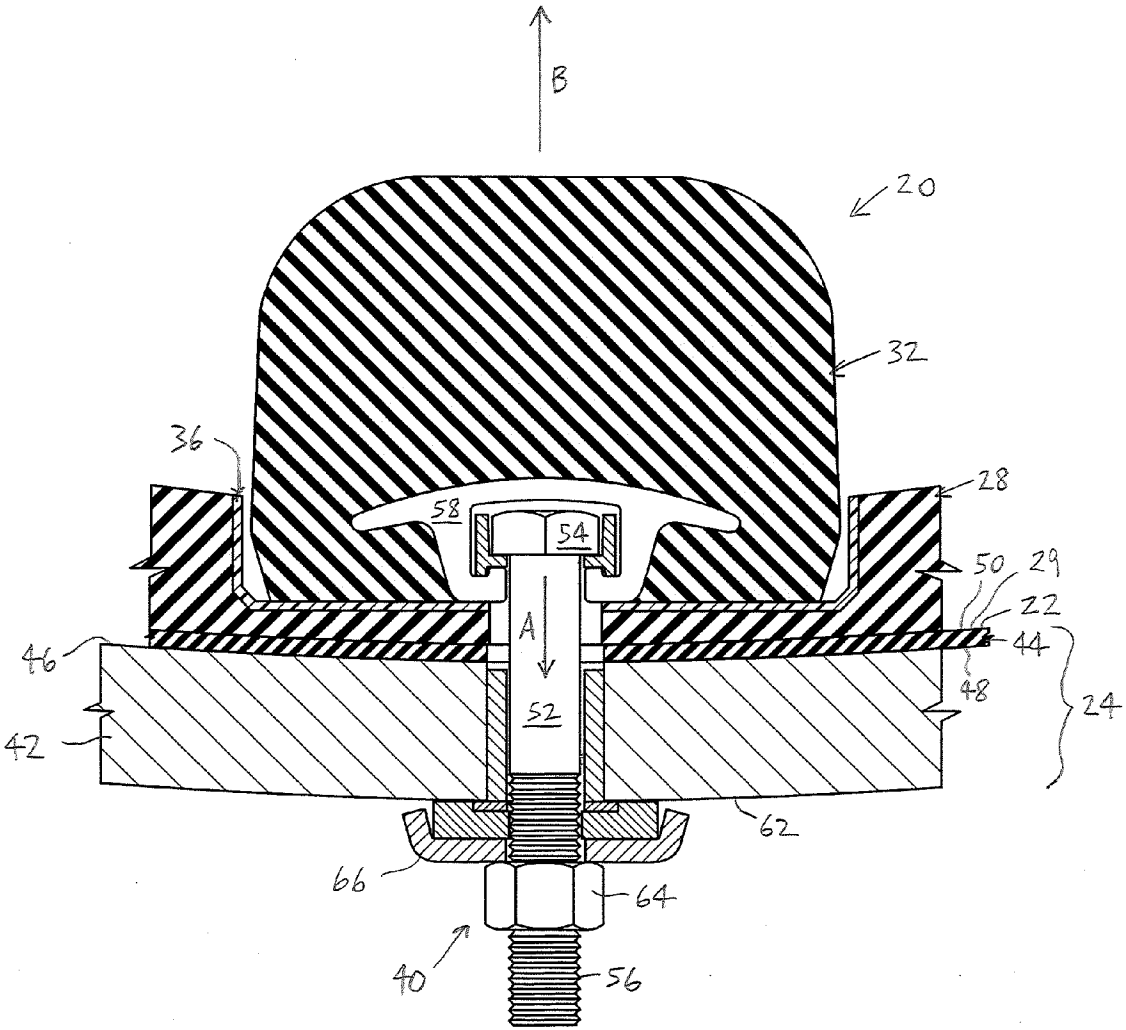
FIG. 1B is a cross-section of a portion of an embodiment of a mill liner assembly of the invention, drawn at a larger scale.

In the attached drawings, like reference numerals designate corresponding elements throughout. Reference is first made to FIGS. 1A-1E, 4A, 4B, and 7A-10 to describe an embodiment of a mill liner assembly of the invention referred to generally by the numeral 20. The mill liner assembly 20 is for mounting on an inner diameter 22 of a shell 24 of a grinding mill 26 (FIG. 1A). In one embodiment, the mill liner assembly 20 preferably includes one or more shell plates 28 for engagement with the shell 24, each shell plate 28 having a cooperating portion 30 (FIGS. 1C, 1D, 4B, 7B). It is also preferred that the mill liner assembly 20 includes one or more lifter bars 32, each lifter bar 32 having a mounting portion 34 thereof (FIG. 1D). The mounting portion 34 preferably is receivable on the cooperating portion 30, as will be described. Preferably, the mill liner assembly 20 also includes one or more layers 36 including one or more substantially non-resilient materials and a substantially non-sticking (i.e., non-adhesive) surface 38. In one embodiment, it is preferred that the layer 36 is at least partially positioned on at least a first selected one of the cooperating portion 30 and the mounting portion 34, to position the non-sticking surface 38 thereof (FIGS. 1D, 4B) for engagement with a second selected one (i.e., the other one) of the cooperating portion 30 and the mounting portion 34, to impede adhesion of the shell plate 28 and the lifter bar 32 with each other (FIGS. 1B, 1D). As will be described, because of the layer 36 positioned therebetween, the lifter bar 32 and the shell plate(s) 28 are relatively easily separable from each other.

As can be seen in FIG. 1B, it is also preferred that the mill liner assembly 20 also includes one or more fastener subassemblies 40, for at least partially securing the shell plates 28 and the lifter bars 32 to the shell 24.

It will be understood that the mill liner assembly 20 preferably includes a number of shell plates 28 and a number of lifter bars 32 that, once installed, are positioned around a circumference of the inner diameter 22 of the shell 24 (FIG. 1A). The shell plates 28 preferably engage a shell surface 29 (FIG. 1B) at least partially defining the inner diameter 22. For clarity of illustration, only a portion of the mill liner assembly 20 is shown in FIG. 1A. A cross-section of a portion of an embodiment of the mill liner assembly 20 is provided in FIG. 1B. FIG. 1D is an exploded view from which the fastener subassembly 40 has been omitted, for clarity of illustration. As will be described, in one embodiment, the lifter bar 32 preferably is positioned on two shell plates, designated 28A and 28B in FIG. 1D for convenience. However, it will be understood that the single lifter bar 32 may alternatively be positioned on a single shell plate 28.

In FIGS. 1A-1D, the layer 36 is shown mounted on the cooperating portion 30 of the shell plate(s) 28. In the embodiment illustrated in FIGS. 1B-1D, the substantially non-sticking surface 38 is positioned for engagement with the mounting portion 34 of the lifter bar 32. Accordingly, in the embodiment of the mill liner assembly 20 illustrated in FIGS. 1B-1D, the "first selected one" (i.e., of the cooperating and mounting portions 30, 34) is the cooperating portion 30. Also, the "second selected one" is the mounting portion 34, in FIGS. 1B-1D.

Figure 4A:
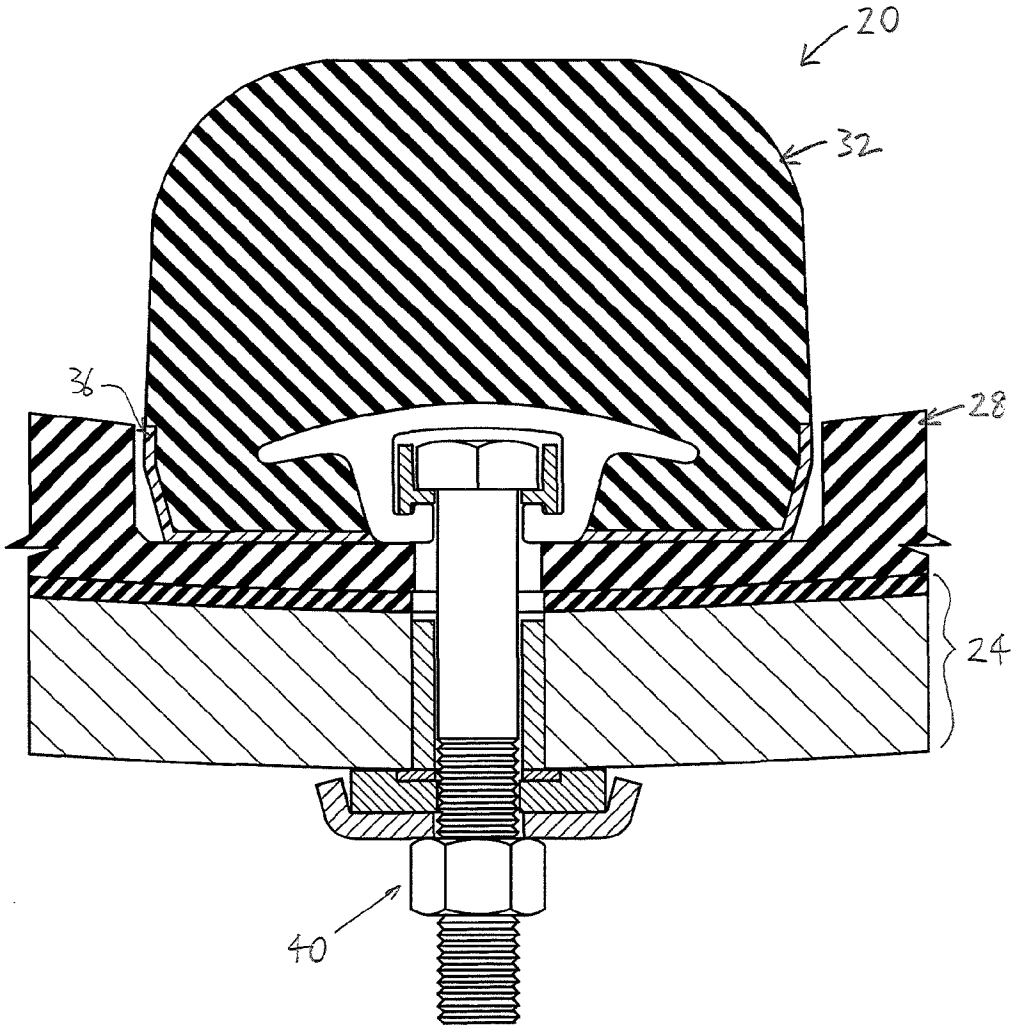
FIG. 4A is a cross-section of a portion of another embodiment of the mill liner assembly of the invention.
Figure 4B:
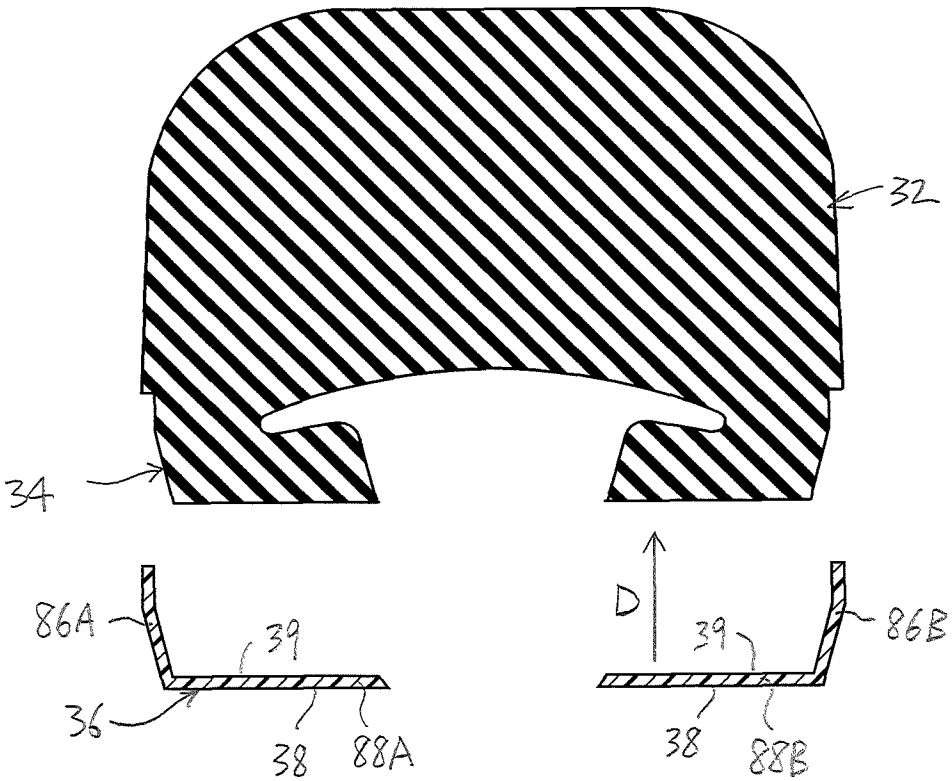
FIG. 4B is an exploded view of certain of the elements illustrated in FIG. 4A.

In FIGS. 4A and 4B, the layer 36 is shown mounted on the mounting portion 34 of the lifter bar 32. In the embodiment illustrated in FIGS. 4A and 4B, the substantially non-sticking surface 38 is positioned for engagement with the cooperating portion 30 of the shell plate(s) 28. Accordingly, in the embodiment of the mill liner assembly 20 illustrated in FIGS. 4A and 4B, the "first selected one" (i.e., of the cooperating and mounting portions 30, 34) is the mounting portion 34. Also, the "second selected one" is the cooperating portion 30, in FIGS. 4A and 4B.

Figure 7A:
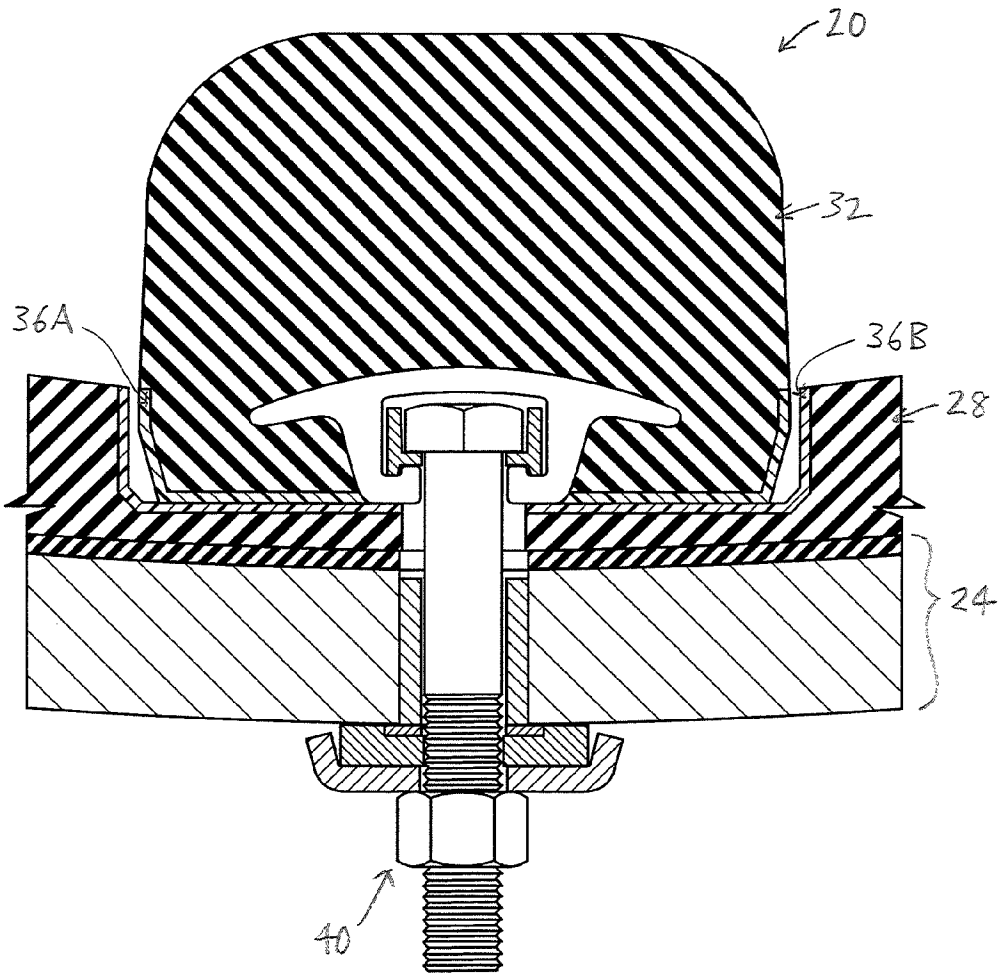
FIG. 7A is a cross-section of a portion of another embodiment of the mill liner assembly of the invention.
Figure 7B:
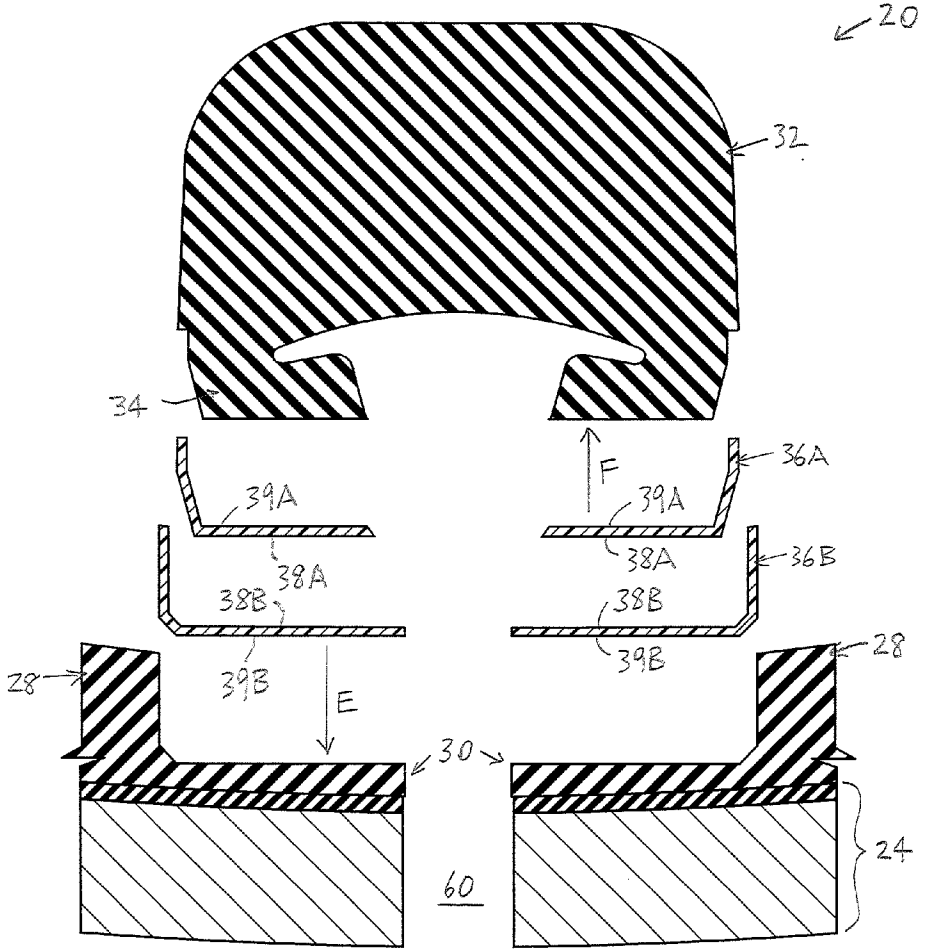
FIG. 7B is an exploded view of certain of the elements illustrated in FIG. 7A.

Another embodiment, in which layers 36 are mounted on both the cooperating and the mounting portions 30, 34 (as will be described), is illustrated in FIGS. 7A and 7B.

Those skilled in the art will appreciate that various arrangements are possible. For instance, the lifter bars may be mounted directly onto the shell, or the shell plates may be formed so that separate lifter bars are not required, as will be described.

Figure 1C:
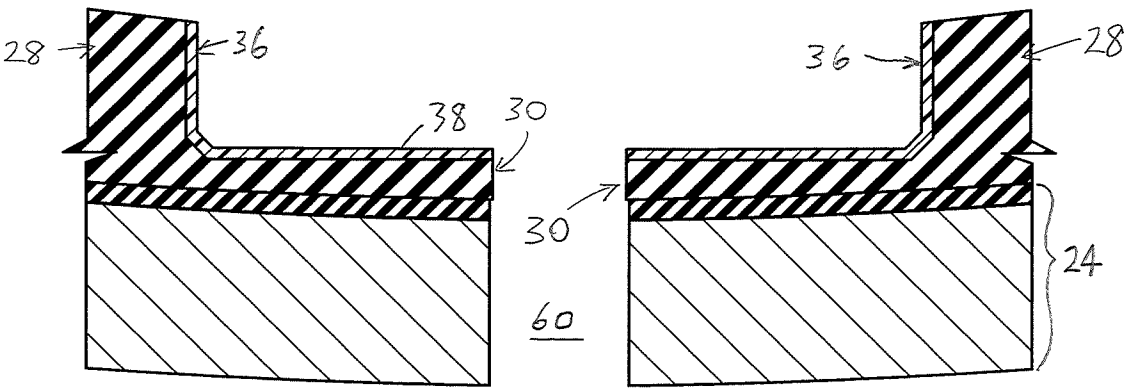
FIG. 1C is a cross-section of a shell and shell plate illustrated in FIG. 1B.
Figure 1D:
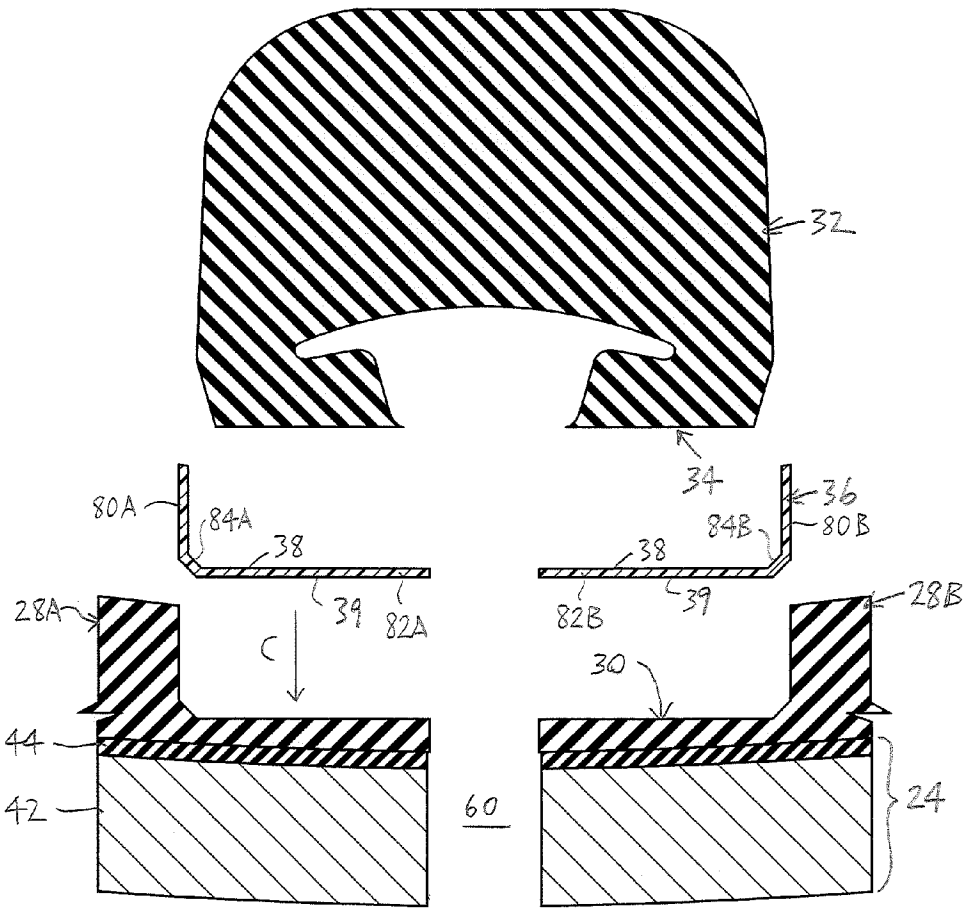
FIG. 1D is an exploded view of the portion of the mill liner assembly illustrated in FIG. 1B.

As can be seen in FIGS. 1B-1D, in one embodiment, the shell plate(s) 28 and the lifter bar 32 preferably are both made of rubber. Those skilled in the art would be aware of the types of rubber that would be suitable. Also, those skilled in the art would be aware that the shell plate(s) 28 and/or the lifter bar 32 may be made of other suitable materials (e.g., steel and/or other suitable materials), and/or combinations of such suitable materials. It will be understood that references to shell plates 28 and lifter bars 32 do not imply that they are necessarily made of any particular material(s) (e.g., rubber or steel or a combination thereof) unless the context otherwise indicates.

As can be seen, for example, in FIG. 1D, the shell 24 preferably includes a shell body 42 and a conventional elastomeric sheet 44. It will be appreciated by those skilled in the art that the shell body 42 preferably is made of a suitable steel, and the elastomeric sheet 44 is intended to protect the shell body 42, e.g., from any corrosive compounds that may be introduced inside the shell. Preferably, the elastomeric sheet 44 is made of any suitable rubber. It is preferred that the elastomeric sheet 44 is relatively thin, e.g., about 3-5 mm. The elastomeric sheet 44 preferably is glued to the shell body 42, using any suitable glue.

As can also be seen in FIG. 1B, the shell body 42 preferably includes an interior surface 46 that is generally concave. Accordingly, when the elastomeric sheet 44 is positioned on the interior surface 46, the elastomeric sheet 44 defines the inner diameter 22, which is generally parallel to the interior surface 46, and is also generally concave. The elastomeric sheet 44 is at least partially defined by an outer side 48 thereof and an opposed inner side 50. The outer side 48 of the elastomeric sheet 44 engages the interior surface 46, and the inner side 50 of the elastomeric sheet 44 defines the inner diameter 22.

As can be seen in FIG. 1D, in one embodiment, the layer 36 is at least partially positioned on the cooperating portion 30 to position the non-sticking surface 38 thereof for engagement with the mounting portion 34. As can be seen in FIGS. 1B and 1D, the mounting portion 34 is engaged by the non-sticking surface 38 when the lifter bar 32 and the shell plate 28 are secured to each other and to the shell 24 by the fastener subassembly 40.

For the purposes hereof, "adhesion" means the act of sticking (to something) or the state of being stuck together. As described above, the layer 36 preferably includes substantially non-resilient material(s), and also preferably includes a substantially non-sticking surface 38 that, in the embodiment illustrated in FIGS. 1B-1D, engages the mounting portion 34 of the lifter bar 32. It will be appreciated by those skilled in the art that, after the mill liner assembly 20 as illustrated in FIG. 1B has been in use for some time, upon loosening and/or at least partially removing the fastener subassembly 40 so that it no longer secures the lifter bar 32 and the shell plate 28 to the shell 24, the lifter bar 32 is relatively easily separable from the shell plate 28.

It can be seen in FIG. 1B that the lifter bar 32 and the shell plate(s) 28 are secured to the shell 24, i.e., with the layer 36 located at least partially between the lifter bar 32 and the shell plate(s) 28. As can be seen in FIG. 1B, the fastener subassembly 40 preferably includes a bolt 52 extending between a head portion 54 and a threaded portion 56. The head portion 54 is positionable in an insert element 58 which is an integral part of the lifter bar 32. When the lifter bar 32 is positioned on the shell plate(s) 28 to be secured to the shell 24, the head portion 54 is positioned in the insert element 58, and the bolt 52 is at least partially positioned in a passage 60 (FIGS. 1C, 1D), so that the threaded portion 56 extends past an outer surface 62 of the shell 24. As shown in FIG. 1D, the passage 60 is between the shell plates 28A, 28B, and also extends through the shell 24. The fastener subassembly 40 preferably also includes a nut 64 threadably engagable with the threaded portion 56, and one or more washers 66 for positioning between the nut 64 and the outer surface 62.

When the lifter bar 32 and the shell plate(s) 28 are to be secured to the shell 24, the nut 64 is tightened, pulling the lifter bar 32 and the shell plate(s) 28 in the direction indicated by arrow "A" in FIG. 1B, i.e., against the shell 24, to secure the lifter bar 32 and the shell plate(s) 28 to the shell 24. When the lifter bar 32 is to be replaced, the nut 64 is removed (i.e., the fastener subassembly 40 is released), and the lifter bar 32 is removable from the shell plate(s) 28.

To remove the lifter bar 32 from the shell plate(s) 28, the lifter bar 32 is separated from the shell plate(s) 28 and moved in the direction indicated by arrow "B" in FIG. 1B. As described above, because the lifter bar 32 is relatively easily separated from the shell plate(s) 28 (i.e., due to the layer 36 positioned therebetween), the lifter bar 32 can be removed when it is worn, and the shell plate(s) 28 can be reused, thereby saving significant costs. Also, significant costs typically incurred in the prior art due to the difficulty of removing the lifter bar from the shell plate(s) are avoided, because of the relatively easy separation of the lifter bar from the shell plate(s) in the invention herein.

Various materials are suitable materials to be included in the layer 36. It will be understood that the layer 36 may include any suitable substantially non-resilient material(s). For instance, in one embodiment, the substantially non-resilient material preferably is ultra high molecular weight polyethylene. Alternatively, in another embodiment, the substantially non-resilient material includes polytetrafluoroethylene. The non-resilient material(s) may provide the substantially non-sticking surface. However, the non-sticking surface may alternatively be provided by additional material(s) included in the layer 36, as will be described. Preferably, the layer 36 is relatively thin. For instance, where the layer 36 is an adhesive tape (as described below), it may have a thickness of approximately 0.07 mm (2.7 mil). In one embodiment, the layer 36 may be applied in the form of a coating. It will be appreciated by those skilled in the art that, because the layer 36 is relatively thin, it can be retrofit (i.e., included in a mill liner of the prior art that was not specifically designed to accommodate the layer) to provide improved performance. Also, the layer 36 preferably is sufficiently thin that it does not materially affect the extent to which the lifter bars and the shell plates are securable to the shell by the fastener subassembly.

The layer 36 is securable to the cooperating portion 30 and/or the mounting portion 34 by any suitable means. For instance, the layer 36 may be so secured by a suitable glue. The glue, or adhesive, may be integral to the layer 36, or the glue may be applied shortly before the layer 36 is applied to the cooperating portion 30 and/or the mounting portion 34.

It is also preferred that the layer 36 includes one or more substantially water-repellent material. This can be advantageous where, for instance, a slurry inside the shell is corrosive.

As described above, the layer 36 is positioned on the cooperating portion 30 so that the substantially non-sticking surface 38 is positioned for engagement with the mounting portion 34 (FIG. 1C). As illustrated in FIG. 1D, the layer 36 preferably includes a backing surface 39 for engagement with the cooperating portion 30, to secure the layer 36 to the cooperating portion 30. Those skilled in the art would be aware of various arrangements for securing the layer 36 to the cooperating portion 30. Preferably, the backing surface 39 is (or includes an) adhesive, so that the layer 36 is secured to the cooperating portion 30 (FIG. 1C).

Where the backing surface 39 of the layer 36 is adhesive, to secure the layer 36 on the cooperating portion 30, the layer 36 is moved onto the cooperating portion 30 (i.e., in the direction indicated by arrow "C" in FIG. 1D), to locate the layer 36 on the cooperating portion 30. Depending on the circumstances, it may be convenient to position the layer 36 on the cooperating portion 30 in this way.

Because of the substantially non-sticking or non-adhesive surface 38, the layer 36 and the mounting portion 34 substantially do not adhere to each other, even after the lifter bar 32 and the shell plate(s) 28 have been secured to the shell 24 for some time. The lifter bar 32 and the shell plate(s) 28 are separated relatively easily due to the substantially non-sticking surface 38, which (in the embodiment illustrated in FIGS. 1B-1D) engages the mounting portion 34. Accordingly, upon release of the fastener subassembly 40, the lifter bar 32 is relatively easily separable from the shell plate(s) 28. However, because the lifter bar 32 and the shell plate(s) 28 are securable to the shell 24 by the fastener subassembly 40, the layer 36 does not materially affect the extent to which such elements are securable to the shell.

As illustrated in FIGS. 4A and 4B, in an alternative embodiment, the layer 36 is at least partially positioned on the mounting portion 34 to position the non-sticking surface 38 thereof for engagement with the cooperating portion 30. Depending on the circumstances, it may be convenient to position the layer 36 on the mounting portion 34. As can be seen in FIGS. 4A and 4B, the layer 36 is positioned on the mounting portion 34 so that the substantially non-sticking surface 38 engages the cooperating portion 30. Because the non-sticking surface 38 engages the cooperating portion 30, the mounting portion 34 and the cooperating portion 30 do not adhere to each other. Due to the substantially non-sticking surface 38, the layer 36 and the cooperating portion 30 substantially do not adhere to each other, even after the lifter bar 32 and the shell plate(s) 28 have been secured to the shell 22 for some time. Accordingly, upon release of the fastener subassembly 40, the lifter bar 32 is relatively easily separable from the shell plate(s) 28.

As illustrated in FIG. 4B, in one embodiment, the backing surface 39 preferably is adhesive, and the layer 36 is secured to the mounting portion 34 by moving the layer 36 onto the mounting portion 34 (i.e., in the direction indicated by arrow "D" in FIG. 4B), to locate the layer 36 on the mounting portion 34.

As can be seen in FIGS. 7A and 7B, in another alternative embodiment, the mill liner assembly 20 preferably includes layers 36A, 36B at least partially positioned on the mounting portion 34 and the cooperating portion 30 respectively, to position the non-sticking surface 38A, 38B of each layer 36A, 36B respectively for engagement with each other, to impede adhesion of the shell plate(s) 28 and the lifter bar 32 to each other. That is, because of the layers 36A, 36B, the lifter bar 32 and the shell plate(s) 28 are relatively easily separable from each other. Preferably, the mill liner assembly 20 also includes a number of fastener subassemblies 40, for at least partially securing the lifter bars 32 and the shell plates 28 to the shell 22.

Because the substantially non-sticking surfaces 38A, 38B are engaged with each other in this embodiment, the mounting and cooperating portions 34, 30 substantially do not adhere to each other. Also, the surfaces 38A, 38B substantially do not adhere to each other. Accordingly, upon release of the fastener subassembly 40, the lifter bar 32 is relatively easily separable from the shell plate(s) 28, even after the lifter bar 32 and the shell plate(s) 28 have been secured to the shell 22 for some time.

As can be seen in FIG. 7B, the layers 36A, 36B include respective substantially non-sticking surfaces 38A, 38B and respective backing surfaces 39A, 39B. Preferably, the backing surfaces 39A, 39B are adhesive, to secure the layers 36A, 36B to the mounting and cooperating portions 34, 30 respectively. The layer 36B preferably is moved onto the cooperating portion 30 (i.e., in the direction indicated by arrow "E" in FIG. 7B), to locate the layer 36B on the cooperating portion 30. Similarly, the layer 36A preferably is moved onto the mounting portion 34 (i.e., in the direction indicated by arrow "F" in FIG. 7B), to locate the layer 36A on the mounting portion 34. It will be understood that the fastening subassembly 40 is omitted from FIG. 7B for clarity of illustration. After the layers 36A, 36B are attached to the mounting and cooperating portions 34, 30 respectively, the lifter bar 32 is positioned on the shell plate(s) 28 (i.e., engaging the layers 36A, 36B with each other), and the fastener subassembly 40 is inserted and tightened, to result in the assembly 20 as illustrated in FIG. 7A.

In one embodiment, the layer 36 of the substantially non-resilient material preferably is an adhesive tape having an adhesive backing on the backing surface 39 (FIG. 4B), for bonding the tape 36 to the first selected one of the cooperating portion 30 and the mounting portion 34, to position the adhesive tape 36 for engaging the non-sticking surface 38 thereof with the second selected one of the cooperating portion 30 and the mounting portion 34. In FIG. 4B, the layer 36 (i.e., adhesive tape) is shown prior to its positioning on the mounting portion 34. (The thickness of the adhesive tape as illustrated is exaggerated in FIGS. 4A and 4B for clarity of illustration.) In FIG. 4B, the adhesive backing 39 of the adhesive tape 36 is positioned for adhesion or bonding to the mounting portion 34. The adhesive tape 36 is shown positioned on the mounting portion 34 in FIG. 4A. As noted above, the adhesive tape 36 preferably is relatively thin, e.g., with a thickness of approximately 0.07 mm (2.7 mil).

In one embodiment, it is preferred that the adhesive tape is a metallic foil tape. Where the adhesive tape 36 is foil tape, the non-sticking surface 38 is provided by the metallic foil portion thereof (FIG. 4B). The metallic foil tape has been found to be effective as the layer 36. However, it has also been found that the adhesive tape works well where the substantially non-sticking surface is provided by other materials, e.g., nylon.

Figure 1E:
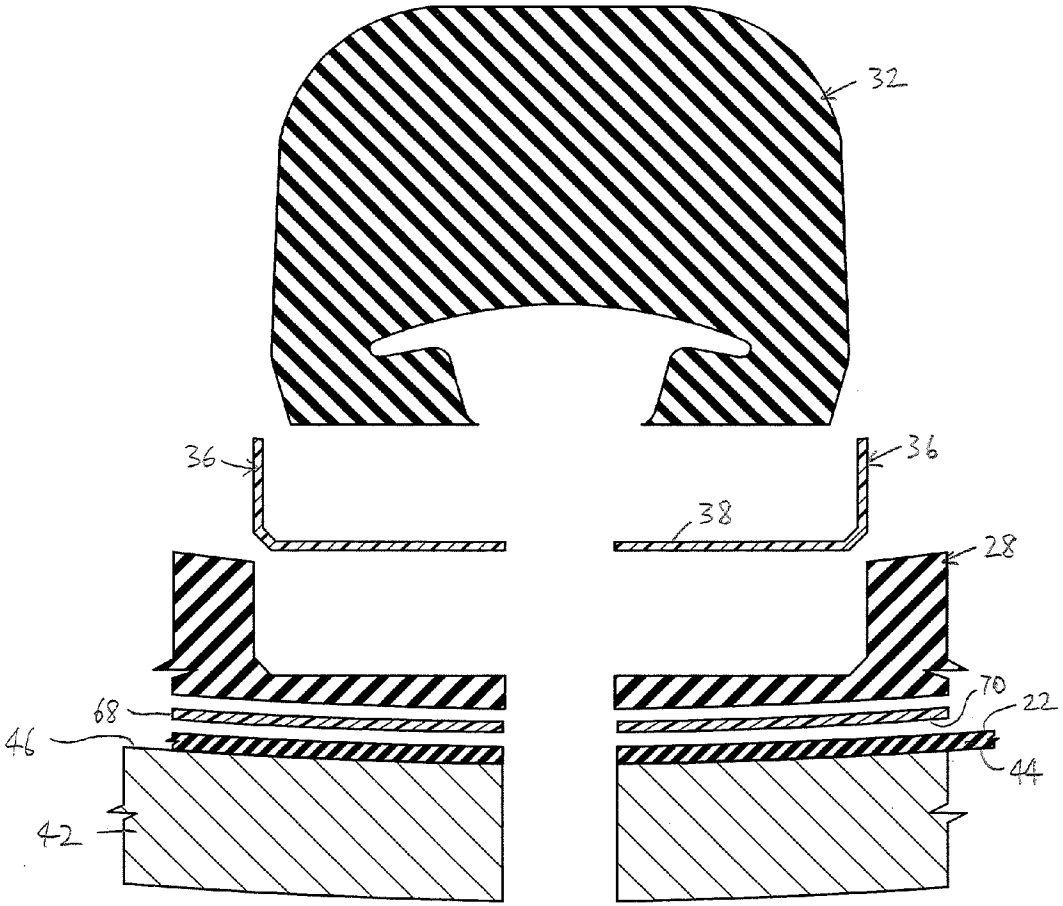
FIG. 1E is an exploded view of an alternative embodiment of a mill liner assembly of the invention.

As described above, the shell 24 preferably includes the shell body 42, which is partially defined by the interior surface 46, and also includes the elastomeric sheet 44 positioned on the interior surface 46 to define the inner diameter 22. As can be seen in FIG. 1E, in another embodiment, the mill liner assembly 20 preferably includes one or more outer elements 68 positionable between the shell plate(s) 28 and the elastomeric sheet 44. It is preferred that the outer element 68 includes a substantially non-adhesive surface 70 positioned for engagement with the elastomeric sheet 44, to impede adhesion of the shell plate(s) 28 and the elastomeric sheet 44 with each other. Preferably, the outer element 68 also includes one or more non-resilient materials. The same materials that are suitable for the layer 36 are also suitable for the outer element 68. It is also preferred that the outer element 68 be relatively thin, e.g., as thin as the layer 36. This facilitates use of the outer element 68 in retrofitting. Also, because it is relatively thin, the outer element 68 is unlikely to materially affect the extent to which the lifter bars and the shell plates are securable to the shell.

In the prior art, separation of the shell plates 28 from the elastomeric sheet 44 can be difficult after a prior art mill liner has been in use for a period of time, probably due (at least in part) to compression set. However, it is desirable to minimize the risk of damage to the elastomeric sheet 44, because the elastomeric sheet 44 protects the shell body 24. As described above, the elastomeric sheet 44 typically is a relatively thin sheet of a suitable material, usually a suitable rubber.

Accordingly, where the outer element 68 is positioned between the shell plate 28 and the elastomeric sheet 44 as described above, separation of the shell plate 28 from the elastomeric sheet 44 is relatively easily achieved. This is because the substantially non-adhesive surface 70 engages the elastomeric sheet 44, when the shell plate 28 is secured to the shell 22. The outer element 68 and the elastomeric sheet 44 substantially do not adhere to each other, even after the shell plate 28 has been secured to the shell 22 for some time. Because of this, the shell plate 28 and the elastomeric sheet 44 substantially do not adhere to each other. Accordingly, when the shall plates 28 are to be removed, they are relatively easily separated from the elastomeric sheet 44.

Figure 7C:
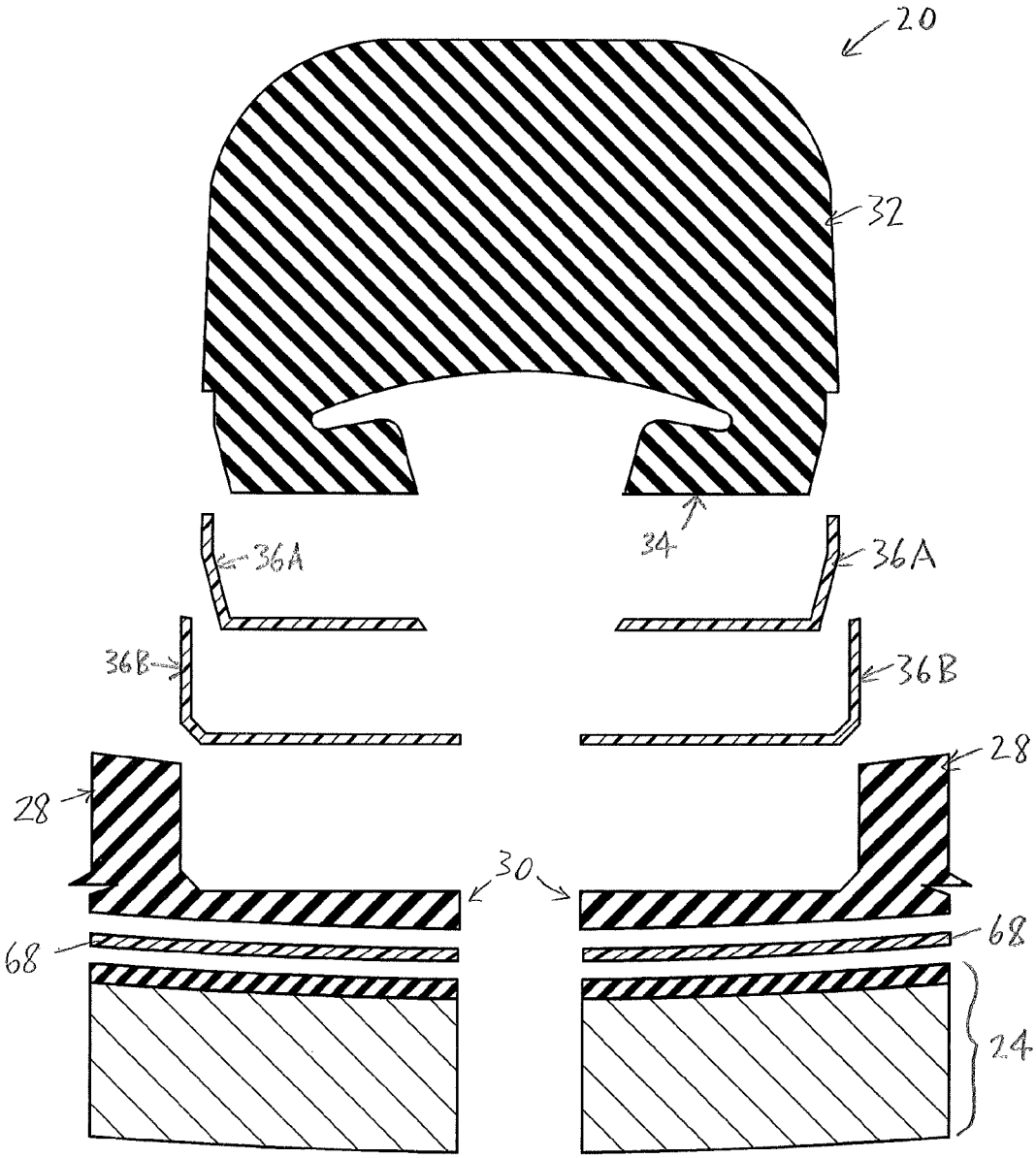
FIG. 7C is an exploded view of another embodiment of a mill liner assembly of the invention.

It will be understood that the mill liner assembly 20, in one embodiment, includes one or more layers 36 as well as the outer element 68. Alternatively, the mill liner assembly 20 may include only the outer element 68, i.e., without the layer(s) 36. For instance, another embodiment of the mill liner assembly 20, including the layers 36A, 36B and also the outer element 68, is illustrated in FIG. 7C.

In another embodiment, the mill liner assembly 20 preferably includes one or more protective elements 72 attached to the shell plate(s) 28 for engagement with the elastomeric sheet 44 when the shell plate(s) 28 is secured to the shell 24. Preferably, the protective element 72 includes one or more substantially tear-resistant (i.e., tough) materials, for protecting the elastomeric sheet 44. Because the protective element 72 is intended to resist abrasion or tearing when the shell plate is moved relative to it, the protective element 72 preferably is relatively tough. The protective element 72 preferably is at least partially made of any suitably tough, and/or tear-resistant material. Those skilled in the art would be aware that various materials are suitable. For instance, it has been found that high-density polyethylene is suitable. The protective element 72 preferably has a thickness between approximately 12 mm and approximately 15 mm. (The protective element 72 is relatively thick compared to the layer 36 because of the significant weight of the steel shell plates 28, i.e., to enable the protective element 72 to resist tearing when steel shell plates are installed.) The protective element 72 preferably is secured to the shell plate in any suitable manner, e.g., by a suitable glue.

Because the protective element 72 preferably is relatively thin and relatively flexible, it can be retrofit (i.e., used with prior art elements not specifically designed to accommodate the layer). Also, including the protective element 72 in the mill liner assembly 20 does not materially affect the extent to which the lifter bars and the shell plates are securable to the shell.

As noted above, the shell plate 28 may be made of any suitable material. For instance, shell plates are often made of a suitable rubber, one or more suitable steels or other metals, or one or more suitable ceramics, or combinations thereof. In practice, it has been found that, where the shell plates 28 are very heavy (e.g., because they are made of steel), there is a tendency to pierce or tear the elastomeric sheet 44 as such shell plates 28 are installed or removed. For instance, the elastomeric sheet 44 may be damaged when the heavy shell plates 28 are dragged over the elastomeric sheet 44, to make small adjustments in the shell plates' positions. Accordingly, the invention provides the protective element 72, for further protecting the elastomeric sheet 44 in this situation (FIG. 8).

As described above, the lifter bar 32 and the shell plate(s) 28 preferably are secured to the shell 24 by the fastener assembly 40. As can be seen, for instance, in FIG. 4A, the fastener subassembly 40 includes the bolt 52 which is at least partially positioned in the passage 60. In FIG. 8, it can be seen that the passage 60 includes an opening 74 in the shell 22.

Figure 8:
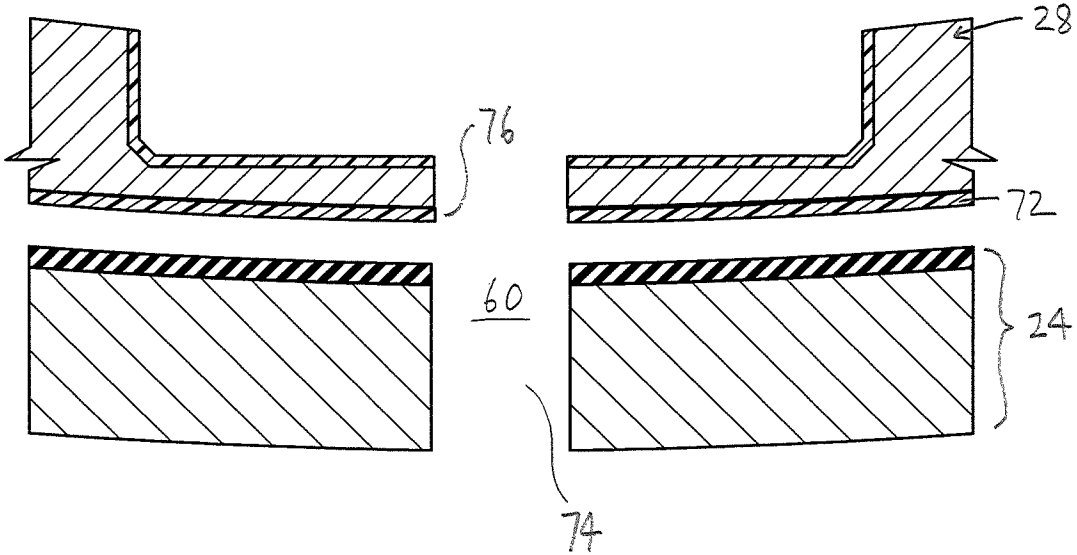
FIG. 8 is an exploded view of another embodiment of a mill liner assembly of the invention.

In one embodiment, and as can be seen in FIG. 8, the shell 22 includes the opening 74, in which the fastener subassembly 40 is at least partially positionable, as described above, to secure the shell plate(s) (and the lifter bar) to the shell 22. Preferably, and as can be seen in FIG. 8, the protective element 72 includes one or more apertures 76 positioned to register with the opening 74 in the shell 22, to permit the fastening subassemblies 40 to be positioned at least partially in the apertures 76. Advantageously, with the apertures 76 preformed in the protective element 72 to register with the openings before the protective element 72 is attached to the shell plate(s) 28, the shell plate(s) 28 are more quickly installed than in the prior art. (In the prior art, apertures intended to register with the openings typically are manually formed during installation, in a labor-intensive process.)

It will be understood that the protective element 72 may be used regardless of whether the mill liner assembly 20 includes any one or more of the layers 36. From the foregoing it can be seen that, because of the protective element 72, the risk of damage to the elastomeric sheet 44 is significantly decreased.

Figure 9:
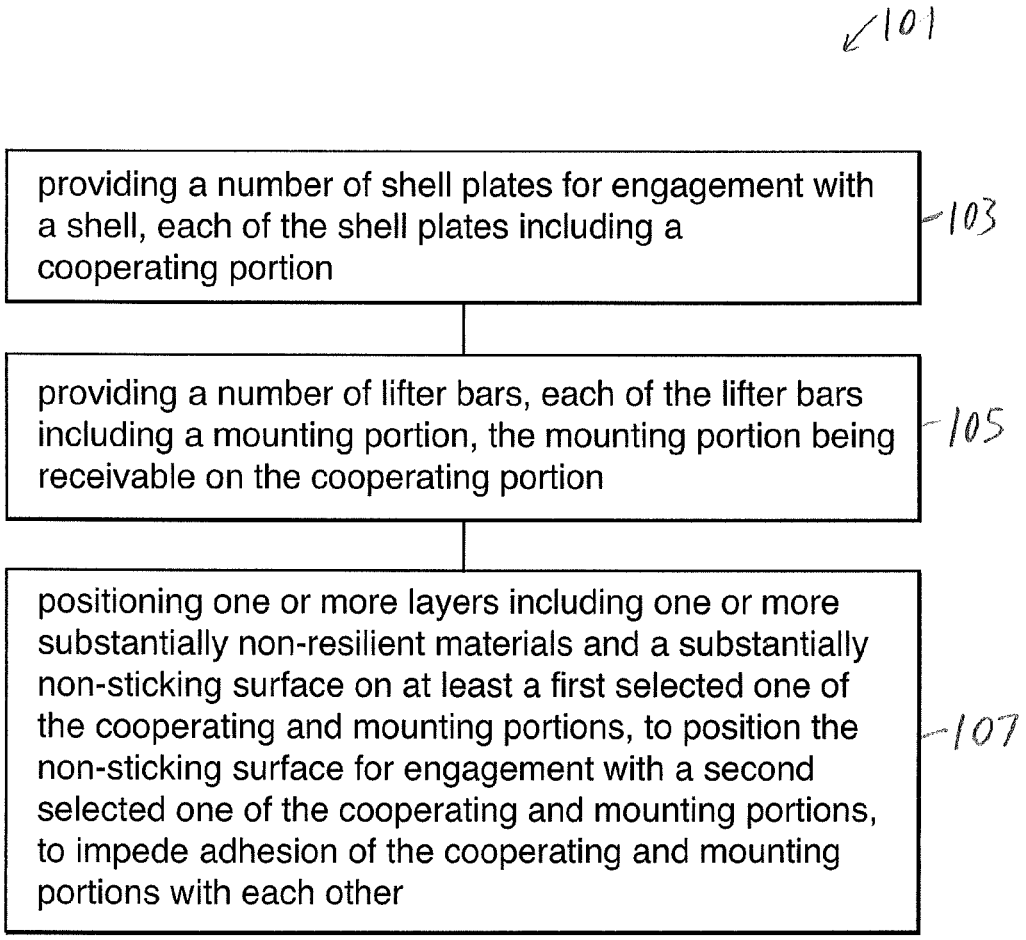
FIG. 9 is a flow chart schematically illustrating an embodiment of a method of the invention.

In use, the mill liner assembly 20 is formed by an embodiment of a method 101 of the invention including the steps of providing one or more shell plates 28 for engagement with the shell 22, each shell plate 28 including the cooperating portion 30 thereof (step 103, FIG. 9). The method 101 also includes the step of providing one or more lifter bars 32, each lifter bar 32 including the mounting portion 34 thereof, the mounting portion 34 being receivable on the cooperating portion 30 (step 105). Also, the method 201 includes the step of positioning one or more layers 36 including the substantially non-resilient material and the substantially non-sticking surface 38 on at least the first selected one of the cooperating portion 30 and the mounting portion 34, to position the non-sticking surface 38 thereof for engagement with the second selected one of the cooperating portion 30 and the mounting portion 34, to impede adhesion of the shell plate(s) 28 and the lifter bar 32 to each other (step 107). Because of the layer 36, the lifter bar 32 and the shell plate(s) 28 are relatively easily separable from each other.

It will be appreciated by those skilled in the art that certain steps of the method 101 may be performed in an alternative sequence. For instance, although step 103 is described above and is shown in FIG. 9 as preceding step 105, the sequence of these steps is not functionally significant.

Figure 10:
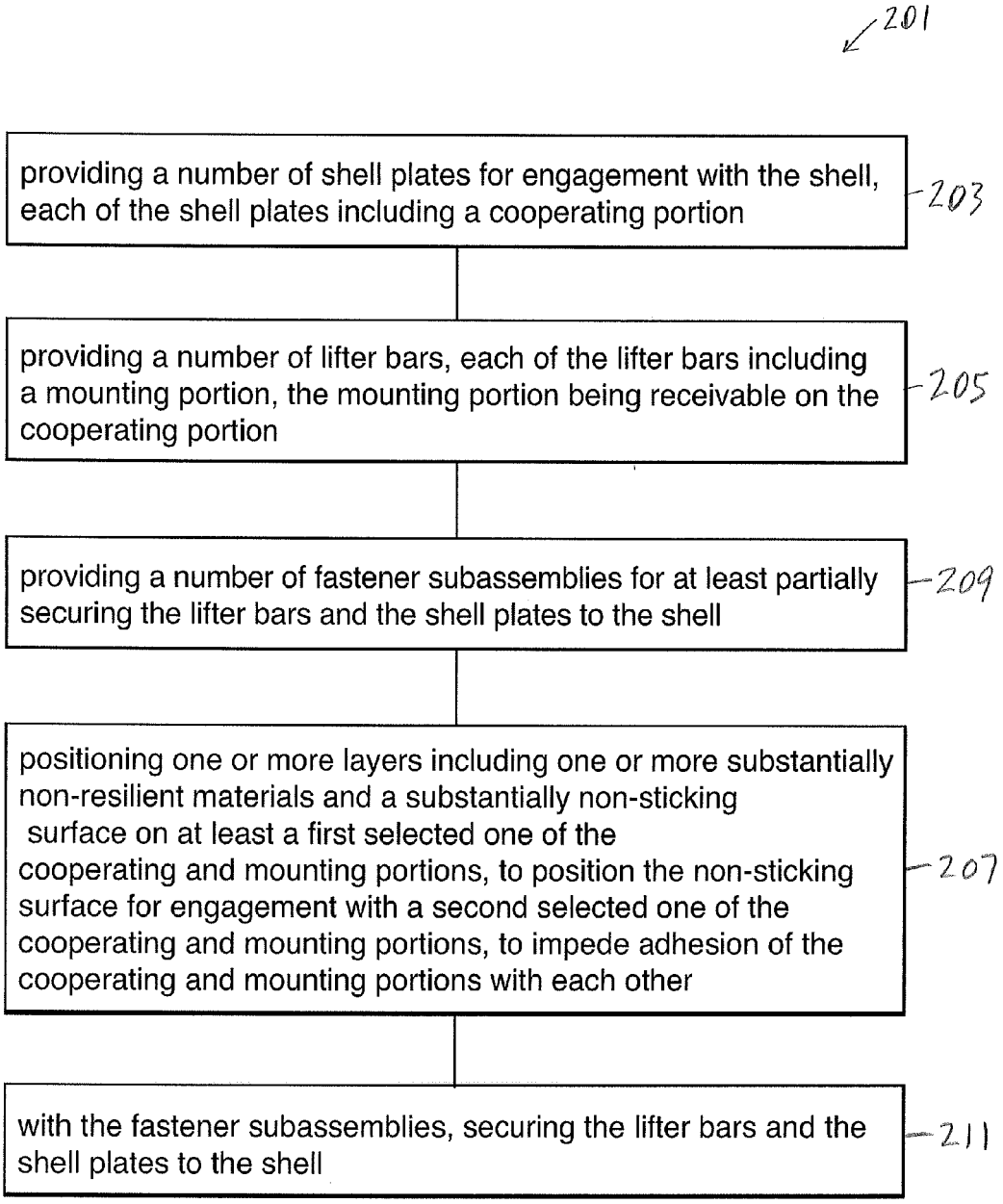
FIG. 10 is a flow chart schematically illustrating another embodiment of a method of the invention.

Another embodiment of a method 201 of the invention of securing the mill liner assembly 20 to the shell 22 of the grinding mill 26 includes the step of providing a number of shell plates 28 for engagement with the shell, each shell plate 28 having a cooperating portion 30 thereof (step 203, FIG. 10). Also, the method 201 includes providing a number of lifter bars 32, each lifter bar 32 having a mounting portion 34 thereof, the mounting portion 34 being receivable on the cooperating portion 30 (step 205). The method 201 also includes providing a number of fastener subassemblies 40, for at least partially securing the shell plates 28 and the lifter bars 32 (step 209). Also, one or more layers 36 is positioned on at least the first selected one of the cooperating portion 30 and the mounting portion 34, to position the non-sticking surface 36 thereof for engagement with the second selected one of the cooperating portion 30 and the mounting portion 34, to impede adhesion of the cooperating portion 30 and the mounting portion 34 with each other (step 207). Finally, with the fastener subassemblies 40, the lifter bars 32 and the shell plates 28 are secured to the shell 22 (step 211).

In another embodiment, the invention provides the grinding mill 26, which preferably includes the shell 24 with the inner diameter 22 thereof, and the mill liner assembly 20 for mounting on the inner diameter 22 of the shell 24. Preferably, and as described above, the mill liner assembly 20 includes a number of shell plates 28, a number of lifter bars 32, and a number of fastener subassemblies 40. It is also preferred that the mill liner assembly 20 includes one or more layers 36, each of which includes one or more substantially non-resilient materials and the substantially non-sticking surfaces 38. Also as described above, the layer 36 preferably is positioned on at least the first selected one of the cooperating and mounting portions, for engagement with the other of the cooperating and mounting portions 34, 30, i.e., the second selected one thereof, to position the non-sticking surface 38 for engagement with the other of the cooperating and mounting portions (i.e., the second selected one of the cooperating portion and the mounting portion), to impede adhesion of the shell plate(s) 28 and the lifter bar 32 to each other, when the shell plates and the lifter bars are attached to the shell by the fastener subassemblies 40. Because of the layer 36, the lifter bar 36 and the shell plate(s) 28 are relatively easily separable from each other.

In another embodiment, the invention provides the mill liner assembly 20 including a number of the shell plates 28 for engagement with the inner diameter 22 of the shell 24 of the grinding mill 26. Each of the shell plates 28 includes the cooperating portion 30 thereof and a number of lifter bars 32, each lifter bar 32 including the mounting portion 34. The mounting portion 34 is receivable on the cooperating portion 30. The shell 24 includes the shell body 42 having the interior surface 46, and the elastomeric sheet 44 positioned on the interior surface 46 to define the inner diameter 22. Preferably, the mill liner assembly 20 also includes one or more outer elements 68 positionable between the shell plate 28 and the elastomeric sheet 44. Preferably, the outer element 68 includes the substantially non-adhesive surface 70 positioned for engagement with the elastomeric sheet 44, to impede adhesion of the shell plate and the elastomeric sheet with each other.

In another embodiment, the invention includes the mill liner assembly 20, which includes a number of shell plates 28 for engagement with the inner diameter 22 of the shell 24 of the grinding mill 26, the shell including the shell body 42 having the interior surface 46 and the elastomeric sheet 44 positioned on the interior surface 46 to define the inner diameter 22. The mill liner assembly 20 preferably also includes the protective element(s) 72 attached to the shell plate(s) 28 for engagement with the elastomeric sheet 44 when the shell plate 42 is fastened to the shell 24, the protective element 72 including one or more substantially tear-resistant materials, for protecting the elastomeric sheet 44.

Alternative embodiments of the mill liner assembly of the invention are illustrated in FIGS. 2, 3, 5, 6, and 11A-12B. It is believed that these alternative embodiments may be advantageous in different applications, depending on the circumstances in each case.

As described above, in FIGS. 1B-1D, the layer 36 is shown as being mounted or secured to the cooperating portion 30 of the shell plate(s) 28. As can be seen, for example, in FIG. 1D, the layer 36 preferably includes side elements 80A, 80B and main elements 82A, 82B. The side elements 80A, 80B and the main elements 82A, 82B preferably are joined by corner elements 84A, 84B respectively.

Those skilled in the art will appreciate that, in alternative embodiments of the invention, the layer 36, when mounted on the cooperating portion 30, may have alternative configurations.

Figure 2:
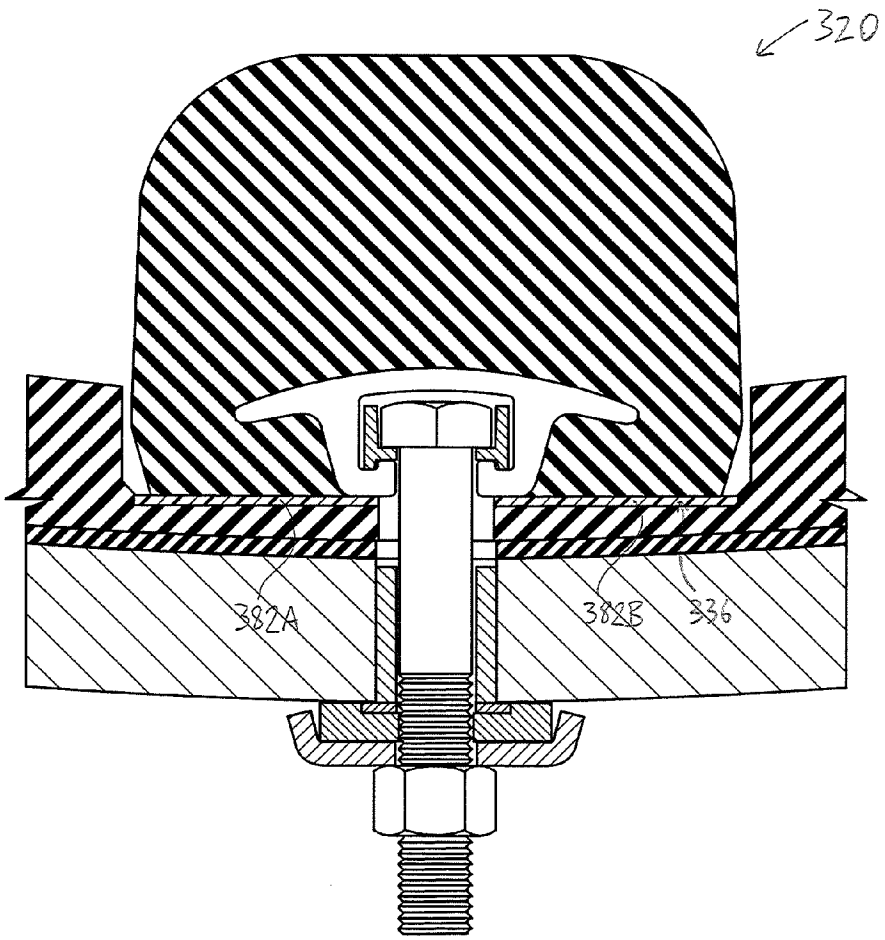
FIG. 2 is a cross-section of a portion of another embodiment of the mill liner assembly of the invention.

For example, an alternative embodiment of the mill liner assembly 320 of the invention is illustrated in FIG. 2. As can be seen in FIG. 2, a layer 336 in this embodiment includes only the main elements 382A, 382B.

Figure 3:
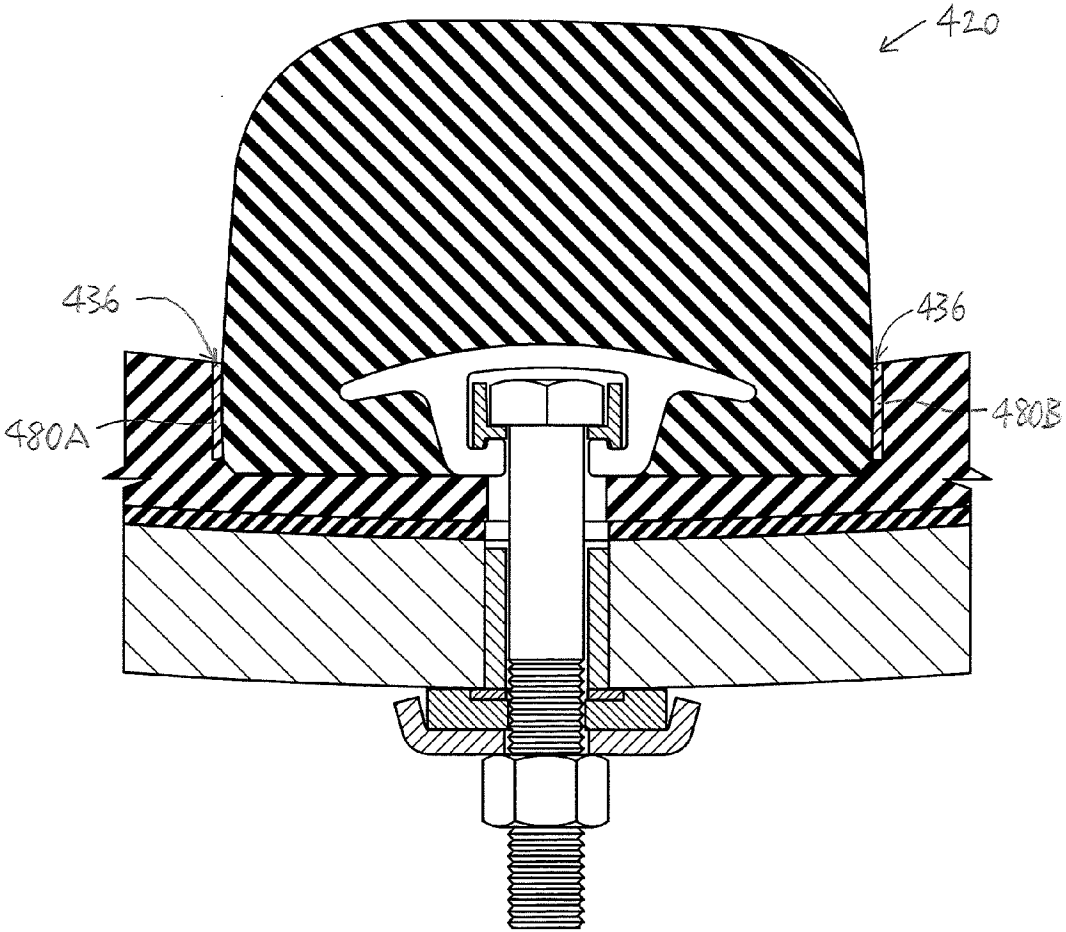
FIG. 3 is a cross-section of a portion of another embodiment of the mill liner assembly of the invention.

An alternative embodiment of a mill liner assembly 420 of the invention is illustrated in FIG. 3. In this embodiment, a layer 436 includes only side elements 480A, 480B.

As described above, the layer of substantially non-resilient material with the substantially non-sticking surface may alternatively be mounted on the mounting portion 34. As can be seen in FIG. 4B, for example, in one embodiment, the layer 36 includes side parts 86A, 86B and base parts 88A, 88B.

Figure 5:
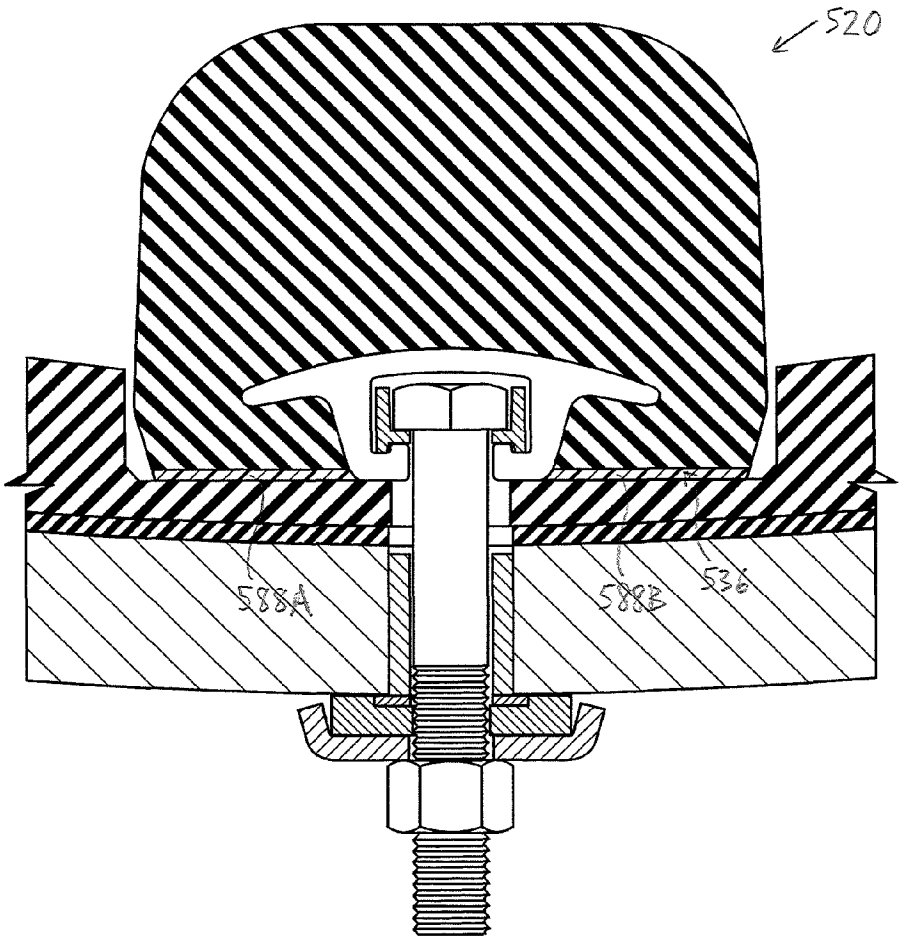
FIG. 5 is a cross-section of a portion of another embodiment of the mill liner assembly of the invention.
Figure 6:
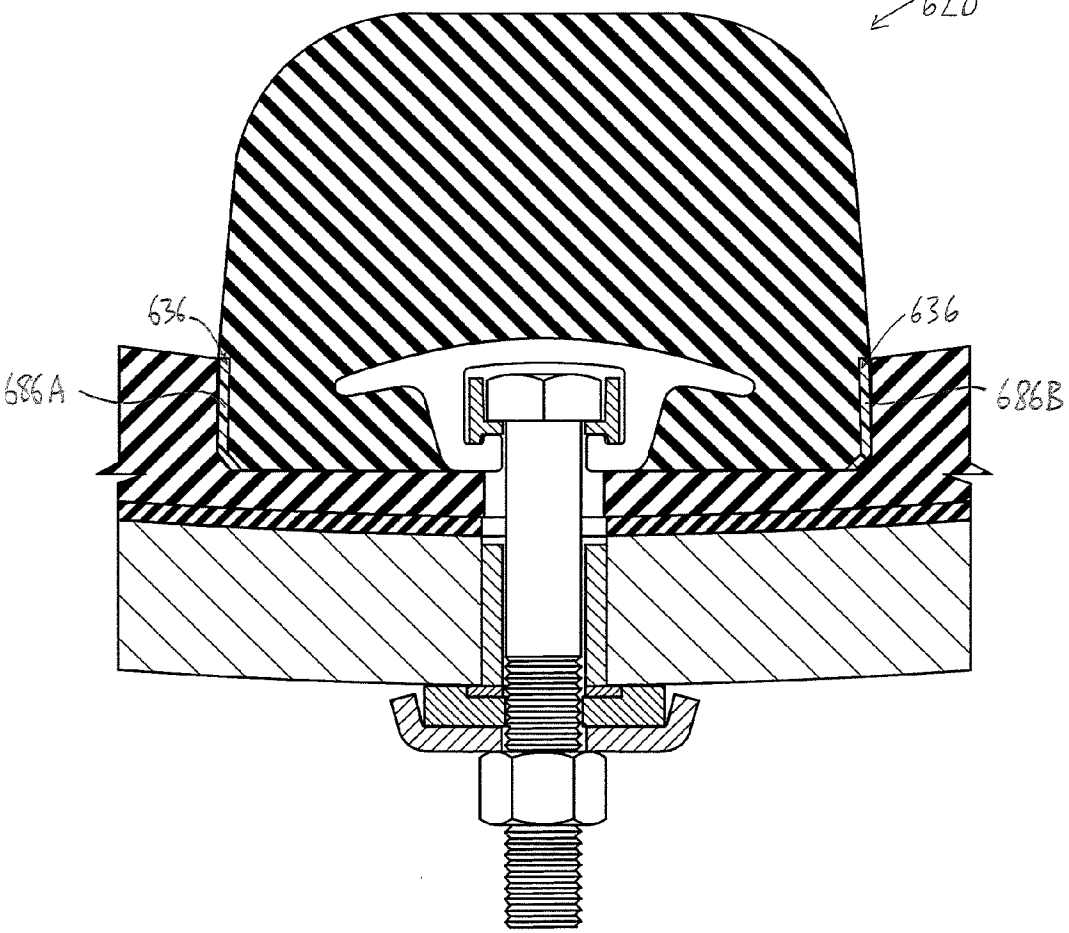
FIG. 6 is a cross-section of a portion of another embodiment of the mill liner assembly of the invention.

Another alternative embodiment of a mill liner assembly 520 of the invention is illustrated in FIG. 5. As can be seen in FIG. 5, a layer 536 in this embodiment includes only the base parts 588A, 588B.

Yet another alternative embodiment of a mill liner assembly 620 of the invention is illustrated in FIG. 5. In this embodiment, a layer 636 includes only the side parts 686A, 686B.

In another embodiment, a mill liner assembly 720 of the invention includes one or more lifter bars 732 for engagement with a shell surface 729 defining an inner diameter 722 of a shell 724 of a grinding mill 726. Each of the lifter bars 732 includes a mounting portion 734 which is receivable on the shell surface 729. Preferably, the mill liner assembly 720 also includes one or more layers 736 including one or more non-resilient materials, and a substantially non-sticking surface 738 that is at least partially positioned on a first selected one of the mounting portion 734 and the shell surface 729, to position the non-sticking surface 738 for engagement with a second selected one (i.e., the other one) of the mounting portion 734 and the shell surface 729, to impede adhesion of the lifter bar 732 and the shell 724 to each other. Because of the layer 736, the lifter bar 732 is relatively easily separable from the shell 724.

Figure 11A:
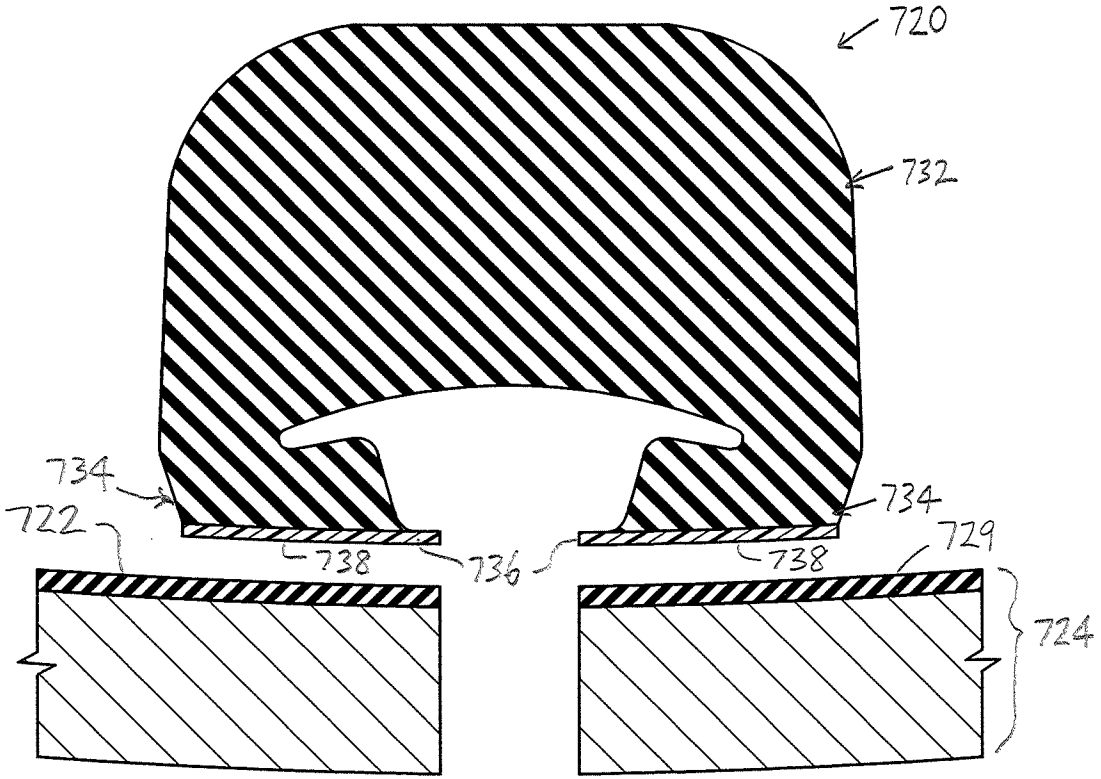
FIG. 11A is an exploded view of another embodiment of a mill liner assembly of the invention.
Figure 11B:
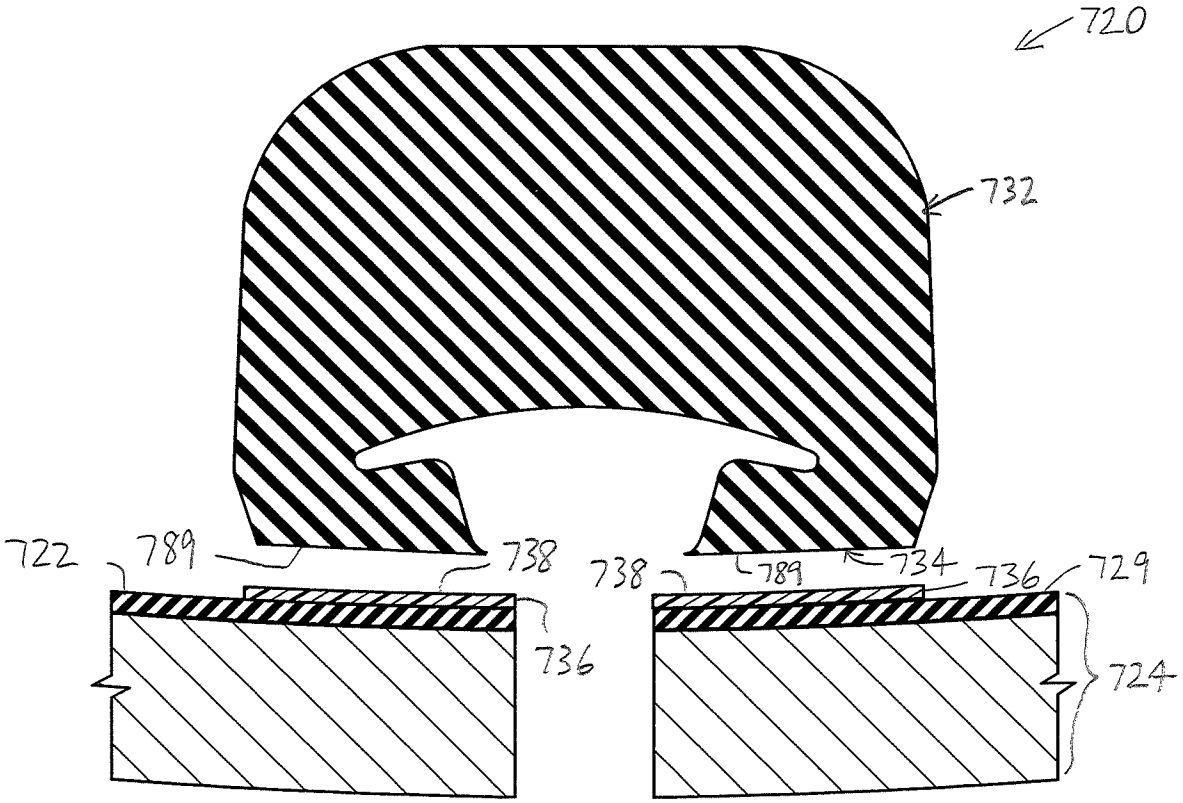
FIG. 11B is an exploded view of another embodiment of a mill liner assembly of the invention.

As can be seen in FIGS. 11A and 11B, in the mill liner assembly 720, the lifter bar 732 is designed to be mounted directly on the shell 724. It will be understood that fastener subassemblies are omitted from FIGS. 11A and 11B for clarity of illustration.

In FIG. 11A, the layer 736 is mounted on the lifter bar 732, so that the non-sticking surface 738 is positioned for engagement with the shell surface 729. That is, in FIG. 11A, the first selected one is the mounting portion 734 of the lifter bar 732, and the second selected one is the shell surface 729. The layer 736 may be attached to the mounting portion 734 by any suitable means, e.g., a suitable glue.

In FIG. 11B, the situation is reversed. The layer 736 is mounted on the shell surface 729. The non-sticking surface 738 is positioned for engagement with the mounting portion 734 of the lifter bar 732. As can be seen in FIG. 11B, the non-sticking surface 738 engages an external surface 789 of the mounting portion 734 when the lifter bar 732 is secured to the shell 724. In this embodiment, the first selected one is the shell surface 729, and the second selected one is the mounting portion 734. The layer 736 may be attached to the shell surface 729 by any suitable means, e.g., a suitable glue.

In each case, the layer 736 impedes adhesion of the lifter bar 732 and the shell 724 to each other. It will be understood that the layer 736 preferably is sufficiently thin (as described above) that it fits between the lifter bar 732 and the shell 724, e.g., the layer 736 may be retrofit (i.e., used with prior art mill liner elements not specifically designed to accommodate the layer). Due to the non-sticking surface 738, the lifter bar 732 can relatively easily be separated from the shell (i.e., from the shell surface 729), resulting in lower installation costs.

In another embodiment, a mill liner assembly 820 of the invention includes one or more shell plate(s) 828 for engagement with a shell surface 829 defining an inner diameter 822 of a shell 824 of a grinding mill 826. Each of the shell plate(s) 828 includes a cooperating portion 830 which is receivable on the shell surface 829. Preferably, the mill liner assembly 820 also includes one or more layers 836 including one or more non-resilient materials, and a substantially non-sticking surface 838 that is at least partially positioned on a first selected one of the cooperating portion 830 and the shell surface 829, to position the non-sticking surface 838 for engagement with a second selected one (i.e., the other one) of the cooperating portion 830 and the shell surface 829, to impede adhesion of the shell plate(s) 828 and the shell 824 to each other. Because of the layer 836, the shell plate 828 is relatively easily separable from the shell 824.

Figure 12A:
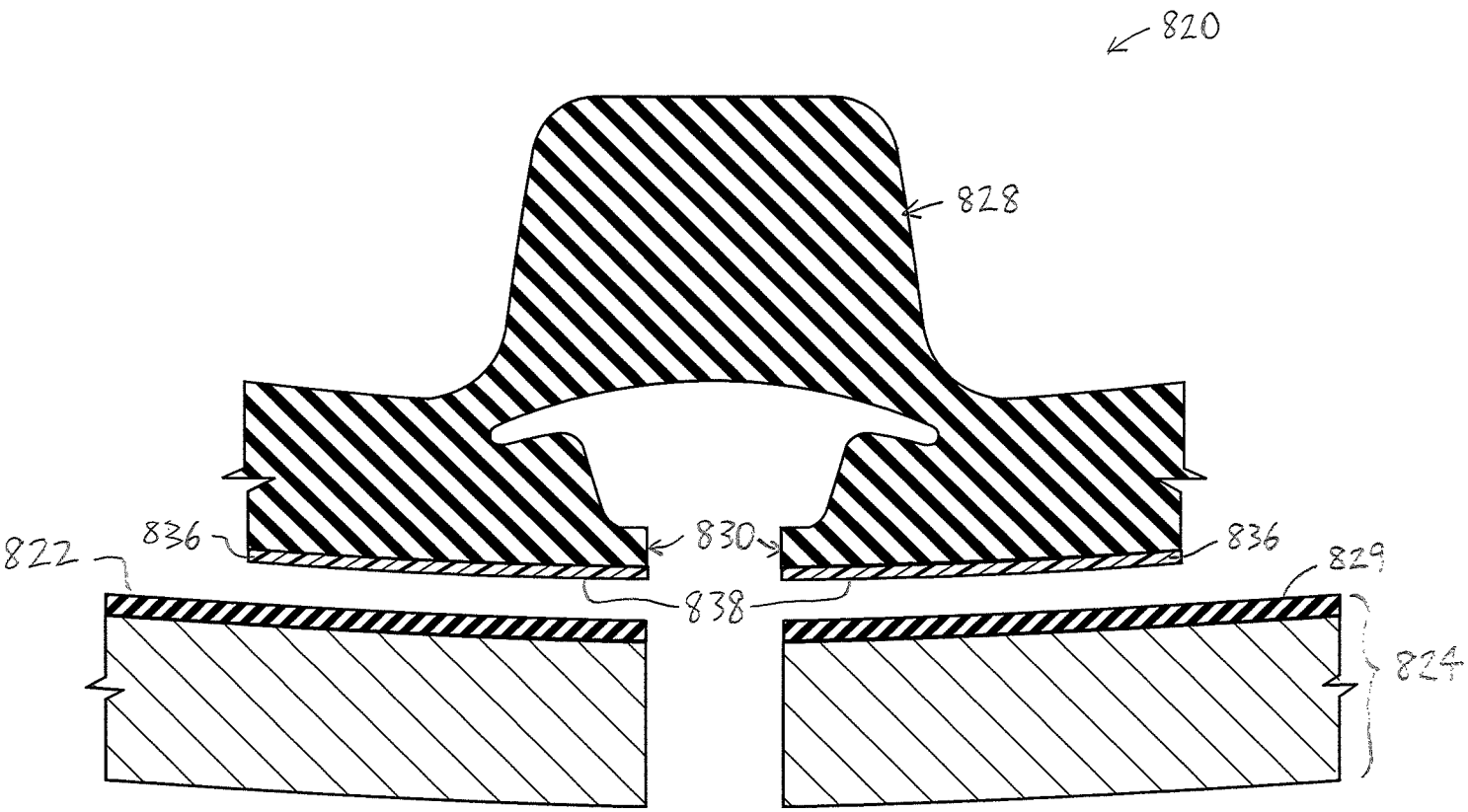
FIG. 12A is an exploded view of another embodiment of a mill liner assembly of the invention.
Figure 12B:
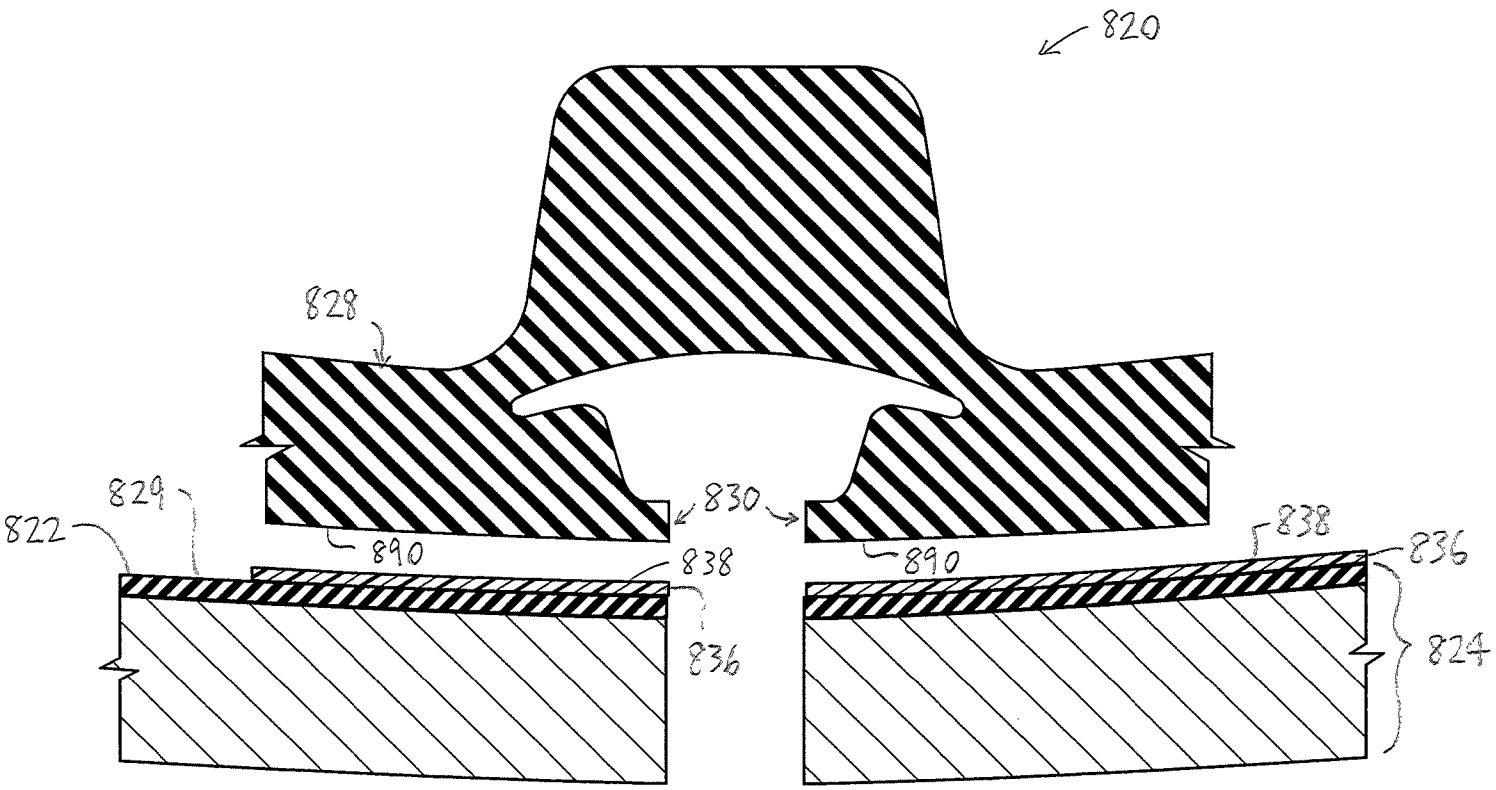
FIG. 12B is an exploded view of another embodiment of a mill liner assembly of the invention.

As can be seen in FIGS. 12A and 12B, in the mill liner assembly 820, the shell plate(s) 828 is designed to be mounted directly on the shell 824. It will be understood that fastener subassemblies are omitted from FIGS. 12A and 12B for clarity of illustration.

In FIG. 12A, the layer 836 is mounted on the shell plate(s) 828, so that the non-sticking surface 838 is positioned for engagement with the shell surface 829. That is, in FIG. 12A, the first selected one is the cooperating portion 830 of the shell plate(s) 828, and the second selected one is the shell surface 829. The layer 836 may be attached to the outer surface 890 by any suitable means, e.g., a suitable glue.

In FIG. 12B, the layer 836 is mounted on the shell surface 829. The non-sticking surface 838 is positioned for engagement with the cooperating portion 830 of the shell plate(s) 828 in this embodiment. As can be seen in FIG. 12B, the non-sticking surface 838 engages an outer surface 890 of the cooperating portion 830 when the shell plate 828 is secured to the shell 824. In this embodiment, the first selected one is the shell surface 829, and the second selected one is the outer surface 890 of the shell plate(s) 828.

In each case, the layer 836 impedes adhesion of the shell plate(s) 828 and the shell 824 to each other. It will be understood that the layer 836 preferably is sufficiently thin (as described above) that it fits between the shell plate(s) 828 and the shell 824, e.g., the layer 836 may be retrofit. Due to the non-sticking surface 838, the shell plate(s) 828 can relatively easily be separated from the shell (i.e., from the shell surface 829), resulting in lower installation costs.

It will be appreciated by those skilled in the art that the invention can take many forms, and that such forms are within the scope of the invention as described above. The foregoing descriptions are exemplary, and their scope should not be limited to the preferred versions provided therein.

We claim:

1. A mill liner assembly for mounting on an inner diameter of a shell of a grinding mill, the mill liner assembly comprising:

at least one shell plate for engagement with the shell, said at least one shell plate comprising a cooperating portion thereof;

at least one lifter bar, said at least one lifter bar comprising a mounting portion thereof, the mounting portion being receivable on the cooperating portion;

at least two layers, each said layer comprising at least one substantially non-resilient material and a substantially non-sticking surface; and said at least two layers being respectively positioned, at least partially, on the cooperating portion and the mounting portion, to position the respective non-sticking surfaces of said at least two layers for engagement with each other, to impede adhesion of said at least one shell plate and said at least one lifter bar to each other.

2. A mill liner assembly according to claim 1 additionally comprising at least one fastener subassembly, for at least partially securing said at least one shell plate and said at least one lifter bar to the shell.

* * * * *